US007931098B2

(12) United States Patent
Aronstam et al.

(10) Patent No.: US 7,931,098 B2
(45) Date of Patent: Apr. 26, 2011

(54) STEERABLE BIT SYSTEM ASSEMBLY AND METHODS

(75) Inventors: Peter Aronstam, Houston, TX (US); Roger Fincher, Conroe, TX (US); Larry Watkins, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/929,344

(22) Filed: Oct. 30, 2007

(65) Prior Publication Data

US 2008/0041629 A1 Feb. 21, 2008

Related U.S. Application Data

(62) Division of application No. 10/938,189, filed on Sep. 10, 2004, now Pat. No. 7,287,604.

(60) Provisional application No. 60/503,053, filed on Sep. 15, 2003.

(51) Int. Cl.
*E21B 7/04* (2006.01)
*E21B 7/08* (2006.01)

(52) U.S. Cl. ..... 175/61; 175/73; 175/266

(58) Field of Classification Search ..... 175/61, 175/73, 24, 27, 266, 263
See application file for complete search history.

(56) References Cited

U.S. PATENT DOCUMENTS

| | | | | |
|---|---|---|---|---|
| 4,086,698 | A | 5/1978 | Sparks | |
| 4,185,704 | A | 1/1980 | Nixon, Jr. | |
| 4,262,758 | A * | 4/1981 | Evans | 175/73 |
| 4,416,339 | A | 11/1983 | Baker et al. | |
| 4,638,873 | A | 1/1987 | Welborn | |
| 4,730,681 | A | 3/1988 | Estes | |
| 5,158,109 | A | 10/1992 | Hare, Sr. | |
| 5,220,963 | A | 6/1993 | Patton | |
| 5,293,945 | A | 3/1994 | Rosenhauch et al. | |
| 5,341,886 | A | 8/1994 | Patton | |
| 5,419,405 | A | 5/1995 | Patton | |
| 5,443,565 | A * | 8/1995 | Strange, Jr. | 175/431 |
| 5,467,834 | A | 11/1995 | Hughes et al. | |
| 5,553,678 | A | 9/1996 | Barr et al. | |
| 5,671,816 | A | 9/1997 | Tibbitts | |
| 5,941,321 | A | 8/1999 | Hughes | |
| 6,092,610 | A | 7/2000 | Kosmala et al. | |
| 6,138,780 | A | 10/2000 | Beuershausen | |

(Continued)

FOREIGN PATENT DOCUMENTS

GB 2039567 A 8/1980

(Continued)

*Primary Examiner* — David J Bagnell
*Assistant Examiner* — David Andrews
(74) *Attorney, Agent, or Firm* — Cantor Colburn LLP

(57) ABSTRACT

A drilling system includes a steerable bottomhole assembly (BHA) having a steering unit and a control unit that provide dynamic control of drill bit orientation or tilt. Exemplary steering units can adjust bit orientation at a rate that approaches or exceeds the rotational speed of the drill string or drill bit, can include a dynamically adjustable articulated joint having a plurality of elements that deform in response to an excitation signal, can include adjustable independently rotatable rings for selectively tilting the bit, and/or can include a plurality of selectively extensible force pads. The force pads are actuated by a shape change material that deforms in response to an excitation signal. A method of directional drilling includes continuously cycling the position of the steering unit based upon the rotational speed of the drill string and/or drill bit and with reference to an external reference point.

18 Claims, 17 Drawing Sheets

U.S. PATENT DOCUMENTS

| | | | | |
|---|---|---|---|---|
| 6,142,250 | A | 11/2000 | Griffin et al. | |
| 6,173,797 | B1 | 1/2001 | Dykstra et al. | |
| 6,209,664 | B1 | 4/2001 | Amaudric du Chaffaut | |
| 6,253,863 | B1 | 7/2001 | Mensa-Wilmot et al. | |
| 6,257,356 | B1 | 7/2001 | Wassell | |
| 6,260,636 | B1 | 7/2001 | Cooley et al. | |
| 6,290,007 | B2 | 9/2001 | Beuershausen et al. | |
| 6,321,862 | B1 | 11/2001 | Beuershausen et al. | |
| 6,349,780 | B1 | 2/2002 | Beuershausen | |
| 6,568,470 | B2 | 5/2003 | Goodson, Jr. et al. | |
| 6,725,947 | B2 | 4/2004 | Palaschenko et al. | |
| 7,201,237 | B2 | 4/2007 | Raney | |
| 7,373,995 | B2 | 5/2008 | Hughes et al. | |
| 2002/0011358 | A1 | 1/2002 | Wassell | |
| 2002/0088648 | A1 | 7/2002 | Krueger et al. | |
| 2002/0112887 | A1* | 8/2002 | Harrison | 175/27 |
| 2004/0238221 | A1* | 12/2004 | Runia et al. | 175/61 |
| 2005/0024232 | A1 | 2/2005 | Gardner et al. | |
| 2008/0000693 | A1 | 1/2008 | Hutton | |

FOREIGN PATENT DOCUMENTS

| | | | |
|---|---|---|---|
| GB | 2050466 | A | 1/1981 |
| GB | 2352464 | | 1/2001 |
| WO | WO0043628 | | 7/2000 |

* cited by examiner

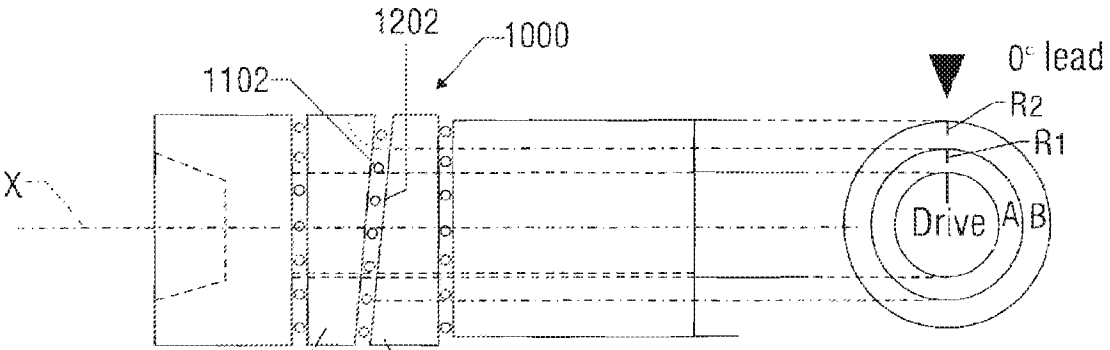
FIG. 13B
FIG. 13A
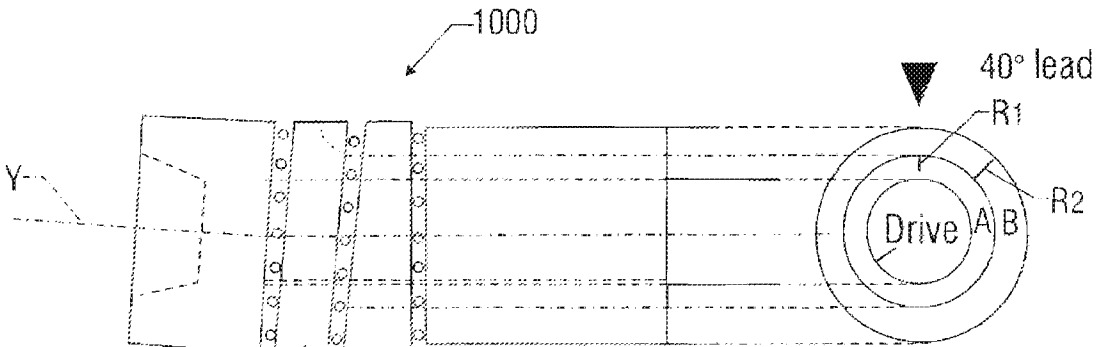
FIG. 14B
FIG. 14A

STEERABLE BIT SYSTEM ASSEMBLY AND METHODS

CROSS-REFERENCE TO RELATED APPLICATIONS

This application is a divisional of U.S. Utility application Ser. No. 10/938,189, filed Sep. 10, 2004 now issued U.S. Pat. No. 7,287,604 which takes priority from U.S. Provisional Application Ser. No. 60/503,053 filed on Sep. 15, 2003.

FIELD OF THE INVENTION

In one aspect, this invention relates generally to systems and methods utilizing materials responsive to an excitation signal. In another aspect, the present invention relates to drilling systems that utilize directional drilling assemblies actuated by smart materials. In another aspect, the present invention related to systems and methods for producing fast response steerable systems for wellbore drilling assemblies.

BACKGROUND OF THE ART

To obtain hydrocarbons such as oil and gas, boreholes are drilled by rotating a drill bit attached at a drill string end. A large proportion of the current drilling activity involves directional drilling, i.e., drilling deviated and horizontal boreholes to place a wellbore as required, to increase the hydrocarbon production and/or to withdraw additional hydrocarbons from the earth's formations. Modern directional drilling systems generally employ a drill string having a bottomhole assembly (BHA) and a drill bit at end thereof that is rotated by a drill motor (mud motor) and/or the drill string. A number of downhole devices placed in close proximity to the drill bit measure and control certain downhole operating parameters associated with the drill string. Such devices typically include sensors for measuring downhole temperature and pressure, azimuth and inclination measuring devices and a resistivity measuring device to determine the presence of hydrocarbons and water. Additional downhole instruments, known as logging-while-drilling ("LWD") tools, are frequently attached to the drill string to determine the formation geology and formation fluid conditions during the drilling operations.

Most hydrocarbon wellbores are currently drilled using a combination of rotary and hydraulic energy sources. Rotation of the drill string is often used as at least one source of the rotary energy. Drilling fluid, or "mud," is used to clean the bore hole and drill bit and to cool and lubricate the drill bit. Because the drilling fluid is pump downhole under pressure, the drilling fluid is often used as an additional source of energy for driving drilling motors that provide some or all of the rotary power required to drill the borehole. Different BHAs are selected depending on the nature of the wellbore 'directional path' and the method by which the wellbore is being drilled (e.g., pure rotary, rotary with downhole motor, or only a downhole motor). Certain BHAs are configured to allow the wellbore to be steered along a pre-determined path. In steered wellbore path drilling, drilling motors or other devices are configured in one or more ways to facilitate controlled steering of the wellbore. In these BHAs, the drill bit is usually connected to a 'drive-shaft' that is supported and stabilized by a series of axial and radial bearings. A drilling motor is used to turn the drive shaft that then turns the bit. The configuration of the motor housing containing the drive-shaft (typically referred to as the bearing housing) and its relationship the remainder of the BHA and drill string allows the well bore to be steered. These motor-based directional BHAs are typically referred to as steerable motor systems.

In recent times, a modification to the motor bearing housing configuration has been introduced to the drilling marketplace. These systems are commonly known as rotary steerable systems. These systems were originally driven or powered by rotation of only the drill pipe, but certain systems presently available combine downhole motors and rotation of the drill string.

Boreholes are usually drilled along predetermined paths and the drilling of a typical borehole proceeds through various formations. To design the path of a subterranean borehole to be other than linear in one or more segments, it is conventional to use "directional" drilling. Variations of directional drilling include drilling of a horizontal, or highly deviated, borehole from a primary, substantially vertical borehole, and drilling of a borehole so as to extend along the plane of a hydrocarbon-producing formation for an extended interval, rather than merely transversely penetrating its relatively small width or depth. Directional drilling, that is to say varying the path of a borehole from a first direction to a second, may be carried out along a relatively small radius of curvature as short as five to six meters, or over a radius of curvature of many hundreds of meters. In many directional boreholes, the well path is a complex 3D curve with multiple radii of curvature. The variation of the curvature (radius) depends upon the pointing (aiming) and bending of the BHA.

Some arrangements for effecting directional drilling include positive displacement (Moineau) type motors as well as turbines that are employed in combination with deflection devices such as bent housing, bent subs, eccentric stabilizers, and combinations thereof. Such arrangements are used in what is commonly called oriented slide drilling. Other steerable bottomhole assemblies, commonly known as rotary steerable systems, alter the deflection or orientation of the drill string by selective lateral extension and retraction of one or more contact pads or members against the borehole wall.

Referring initially to FIG. 1, there is shown a flowchart for an exemplary conventional rotary steering control system 10 for a rotary steerable directional drilling assembly. An intelligent control unit 12 evaluates directional data 14 using programmed instructions 16 and transmits signals 18 as necessary to align the rotary steerable bottomhole assembly with the required well path. With conventional rotary steerable steering systems, there is a time lag between the transmission of the command signals 16 and corresponding physical change of the BHA elements that influence the drilling direction. This time lag is largely attributable to the mechanical and electrical architecture of conventional rotary steering units representatively shown as 20. These conventional rotary steering units 20 employ a number of subsystems 22*a-i* for effecting a change in drilling direction 24. For instance, in one arrangement, subsystem A may be a valve assembly that opens to control hydraulic fluid flow; subsystem B may be a hydraulic chamber that is filled by hydraulic fluid flowing through the valve assembly; subsystem C may be a piston and associated linkages that converts hydraulic pressure in the hydraulic chamber to translational movement; and subsystem D can be an arm or pad that applies a force on a wellbore wall in response to the movement of the piston and associated linkages. In another arrangement, subsystem A can be an electrical circuit that closes to energize an electrical motor within a subsystem B. Subsystem C can be a gear drive that converts motor rotation into translational movement and subsystem D can be mechanism that adjusts the position of a bit in response to the actuation of the gear drive.

The steering control system 10 shown in the FIG. 1 flow chart is merely a generic representation of conventional rotary steerable BHA assemblies wherein all the elements of the system 10 are packaged within the BHA. Limited commands such as a redirection adjustment of target can be sent from the surface. However, the typical rotary steerable BHA is self sufficient from a decision and tool configuration change/adjustment implementation stand point on a moment by moment basis.

The use of multiple subsystems 22*a-i*, whether mechanical, electro-mechanical or hydraulic, can cause hydraulic and mechanical time lags for at least two reasons. First, these conventional subsystems must first overcome system inertia and friction upon receiving the command signal. For instance, motors whether electrical or hydraulic require time to wind up to operating speed and/or produce the requisite motive force. Likewise, hydraulic fluids take time to build pressure sufficient to move a reaction device such as a piston. Second, each interrelated subsystem introduces a separate time lag into the response of the conventional rotary steering drilling system. The separate time lags accumulate into a significant time delay between the issuance and execution of a command signal. In conventional rotary steerable systems, up to several tenths of a second can separate the issuance of a command signal and a corresponding change in drilling direction forces or system geometry that influences drilling direction. If these time lags are great enough relative to drill string RPM and rate of penetration, a reduction in directional control and expected borehole curvature can occur. This can result in a reduction in directional control.

Other configurations of rotary steerable drilling systems minimize the dependency on response time by using a non-rotating stabilizer or pad sleeve. Introduction of the non-rotating (or slow rotating) sleeve decreases the actuation speed requirement but increases the complexity of the steering unit (e.g., the need for rotating seals, rotary electrical connections, etc.). Thus, conventional rotary steerable systems have a limited mechanical response rate, are mechanically complex, or both.

The present invention addresses these and other needs in the prior art.

SUMMARY OF THE INVENTION

In one aspect, the present invention relates to systems, devices and methods for efficient and cost effective drilling of directional wellbores. The system includes a well tool such as a drilling assembly or a bottomhole assembly ("BHA") at the bottom of a suitable umbilical such as drill string. The BHA includes a steering unit and a control unit. In embodiments, the steering unit and control unit provide dynamic control of bit orientation by utilizing fast response "smart" materials. In one embodiment, the control unit utilizes one or more selected measured parameters of interest in conjunction with instructions to determine a drilling direction for the BHA. The instructions can be either pre-programmed or updated during the course of drilling in response to measured parameters and optimization techniques. The control unit issues appropriate command signals to the steering unit. The steering unit includes one or more excitation field/signal generators and a "smart" material. In response to the command signal, the excitation signal/field generator produces an appropriate excitation signal/field (e.g., electrical or magnetic). The excitation signal/field causes a controlled material change (e.g., rheological, dimensional, etc.) in the "smart" material. The utilization of smart materials allows direct control rates that are faster and less mechanically complex than conventional rotary steerable directional systems.

Exemplary embodiments of steering units employing smart materials can control drilling direction by changing the geometry of a BHA ("system geometry change tools"), by generating a selected bit force vector ("force vector systems"), and by controlling the cutting action of the bit ("differential cutting systems").

Steering units that utilize system geometry change steering units to effect a change in drilling direction can employ a "composite geometry change" or "local geometry change." Exemplary composite geometry change steering units can include a deformable sleeve between two attachment points on a rigid tube. These attachment points can be stiffeners, a flange, a diametrically enlarged portion or other suitable feature formed integral with or separate from the drill string or BHA. The sleeve is formed at least partially of one or more smart materials that expand or contract when subjected to an excitation field/signal. By actively controlling the excitation field (e.g., electrical field) associated with the sleeve, the sleeve expands to push the attachment points apart or contracts to pull the attachment points together. This expansion or contraction is transferred to the rigid tube, which then flexes or curls in a selected manner. Exemplary "local geometry change" steering units can include a dynamically adjustable articulated hinge or joint that, when actuated, can adjust the orientation of the bit. The articulated joint can be positioned immediately adjacent to the bit or disposed in the BHA or washer. In one embodiment, the articulated joint includes a washer or ring having a plurality of elements that are at least partially made of one or more solid smart materials. In response to an excitation signal, the elements individually or collectively deform (expand or contract) along a longitudinal axis of the BHA. This controlled longitudinal deformation alters the physical orientation of a face of the ring. This local discontinuity effects a change in the tilt or point of the drill bit. In certain embodiments, a washer face can include a circumferential array of hydraulic chambers filled with a smart fluid (e.g., a fluid having variable-viscosity) and associated pistons. In one application, the smart fluid provides increased or decreased resistance to compression when subjected to an excitation signal, such as an electrical impulse. In this embodiment, the piston individually or collectively contract or relax when subjected to the forces inherent during drilling (e.g., weight on bit). Varying the viscosity alters the distance a given piston shifts, which causes a tilt in the washer face. This tilt causes a local geometry change that controls the physical orientation of the drill bit.

In certain embodiments, the steering unit is incorporated into the bit body. For example, a washer utilizing smart materials can be inserted into a body of the drill bit and placed in close proximity to the bit face. A controller communicates with the washer via a telemetry system to control the excitation signals provided to the smart material used by washer by a suitable generator. The telemetry system can be a short hop telemetry system, hard wiring, inductive coupling or other suitable transmission devices.

Exemplary steering units that utilize force vectors to produce a bit force include one or more stabilizers utilizing smart materials configured to produce/adjust bit side force or alter BHA centerline relative to the borehole centerline. In one embodiment, the stabilizer is fixed to a rotating section of the BHA and includes a plurality of force pads for applying a force against a borehole wall. In this embodiment, steering is effected by a force vector, which creates a reaction force that urges the bit in the direction generally opposite to the force vector. The force pads are actuated by a shape change material that deform in response to an excitation signal produced by a signal/filed generation device or other suitable generator as discussed earlier. The expansion/contraction of the shape change material extends or urges the force pads radially inward and/or outward. In another embodiment, the stabilizer includes a plurality of nozzles that form hydraulic jets of pressurized drilling fluid. The nozzles use a smart material along the fluid exit path to selectively regulate the flow of exiting fluid. The strength of the hydraulic jets can be controlled via a signal/field generator to produce a selected or pre-determined reactive forces. Controlling the hydraulic jet velocity/flowrate can alter the symmetry of the lateral hydraulic force vectors and thus control the direction of the lateral deflection of the drill bit.

In certain embodiments, a deflection device is fixed to a bit to manipulate the radial positioning of the bit relative to the wellbore. In one embodiment, the deflection device includes a plurality of force pads for applying a force against a borehole wall and gage cutters for cutting the borehole wall. The force pads and gage cutters are actuated by a shape change material that expands/contracts in response to an excitation signal. In one mode, either the force pads or gage cutters are extended to contact the borehole wall at a selected frequency. In another mode, the action of the gage cutters and force pads are coordinated such that when a force pad extends out, the corresponding cutter on the opposite side also extends out to cut the borehole wall. A controller communicates with the deflection device via a telemetry system to control the operation of the force pads and gage cutters. The telemetry system can be a short hop telemetry system, hard wiring, inductive coupling or other suitable transmission devices. In other arrangements, the deflection device includes only force pads or only gage cutters. In another embodiment, a hydraulic jet force deflection device fixed in the drill bit uses smart material controlled nozzles along the outer diameter of the bit to produce controllable hydraulic jets to produce reactive forces for controlling the position of the drill bit.

Exemplary differential cutting steering units change well bore path and direction by controlling the forward (face) rate of penetration of the bit. In one embodiment, a drill bit incorporating differential cutting includes a plurality of nozzles that utilize smart materials to modulate the flow through one or more selected nozzles. By selectively and actively changing the flow through one or more of the nozzles, the degree of bottom hole cleaning on one side of the hole can be made more or less effective versus another side. To manage the face segment influenced, the rate or frequency of modulation can be synchronous with the bit rotation or a multiple of a consistent fraction of bit speed. This differential bottom hole cleaning results in a differential rate of penetration across the bottom of the hole. For instance, drilling cuttings accumulate to a greater degree under a selected segment. The relatively greater accumulation of drilling cuttings reduces local ROP and causes the desired change in well path direction. In another embodiment, the drill bit includes a plurality of cutters, which are disposed on a face of the drill bit, that can be individually or collectively (e.g., selected groups) axially lengthened by selectively energizing a smart material. By adjusting the rate of penetration of certain cutters, a differential rate of penetration is created which cause a change in drilling direction. In another embodiment, a differential rate of penetration is provided by actively controlling segmental depth of cut using smart materials to alter the height of one or more depth of cut limiting protrusions provided on a bit face. These embodiment can also provide a controlled distribution of the gross total weight or force on the bit amongst the multiple cutting surfaces. For drill bits utilizing such steering units; data, command signals, and power can be transmitted to the steering unit via a short hop telemetry system, hard wiring, inductive coupling or other suitable transmission devices and systems.

For "oriented slide drilling," which are substantially stationary relative to the wellbore during operation, an associated control unit transmits excitation signals that effectively bend a portion of the BHA (e.g., through local geometry change or composite geometry change) to create a tilt angle that points the bit in a specified direction. Because the steering unit is not rotating relative to the wellbore, this bend can remain substantially fixed (other than to correct for changes in BHA and/or steering unit orientation) until the next desired change in bit direction/orientation.

For steering units that rotate during operation, the control unit energizes or activates the actively controlled elements (e.g., washer segments, nozzles, force pad segments, etc.) of that steering unit as a function of the rotational speed of the steering unit (which may be the rotational speed of a drill string or drill bit). For example, a specified bend or tilt may require one or more elements to be activated while in a specified azimuthal location in the wellbore (e.g., top-dead-center of the wellbore). The azimuthal location can be a point or zone. The elements rotate into the specified location once per shaft revolution. Thus, the control unit energizes the elements every time the elements are in that location. The control unit can also activate the element at one or fewer than one times per reference rotation/cycle provided that the elements are in the selected location. This provides a means for tuning or adjusting the directional deflection aggressiveness via frequency of activation in addition to the amount of shape change.

The control unit can be programmed to adjust one or more operational parameters or variables in connection with the activation of the elements. For instance, the control unit can control the timing or sequence of activation. For example, the region for activation may be a single point or a specified region (e.g., a selected azimuthal sector) or multiple locations. Also, the control unit can simultaneously or sequentially activate any number of elements is selected groups or sets. Additionally, the control unit can control the magnitude or strength of the excitation signal to control the amount of material change (e.g., length change) of the smart material. For instance, by controlling the signal/field intensity, the control unit can change the length of the element and/or the magnitude of the force produced by the element. By controlling these illustrative variables, and other variables, the control unit can control the degree or aggressiveness of path deflection.

In certain embodiments of the present invention employ mechanical steering devices that may or may not utilize smart materials. In one such embodiment, a mechanical adjustable joint is disposed in a section of a BHA. The joint includes two or more members that have sloped/inclined faces (e.g., tubulars, plates, disks, washers, rings) and can rotate relative to one another. A positional sensor package associated with a rotating member (e.g., drilling tubular) provides drilling torque and WOB for a drilling operation. By referencing an external reference plane and actively correlating an internal reference plane to the external reference plane, the sensor package defines a known orientation to the reference vector during random rotation of the rotating member. The sensor package transmits the orientation data to a control/driver device that controls a secondary rotary drive device coupled to one or more of the members having sloped/inclined faces of the adjustable joint. In one embodiment, the drive device counter rotates the ring positioned on the rotating member to maintain a fixed or desired orientation to the external reference plane. While the devices are shown as part of a drill string or BHA, these devices can also be incorporated into a drill bit body in a manner previously described.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawing:

FIG. 13A illustrates one embodiment of a dynamically adjustable mechanical joint in accordance with the present invention;

FIG. 13B illustrates a sectional view of the FIG. 13A embodiment;

FIG. 14A illustrates the FIG. 13A embodiment having a selected tool centerline deflection;

FIG. 14B illustrates a sectional view of the FIG. 14A embodiment; and

DETAILED DESCRIPTION OF PREFERRED EMBODIMENTS

Figure 1:
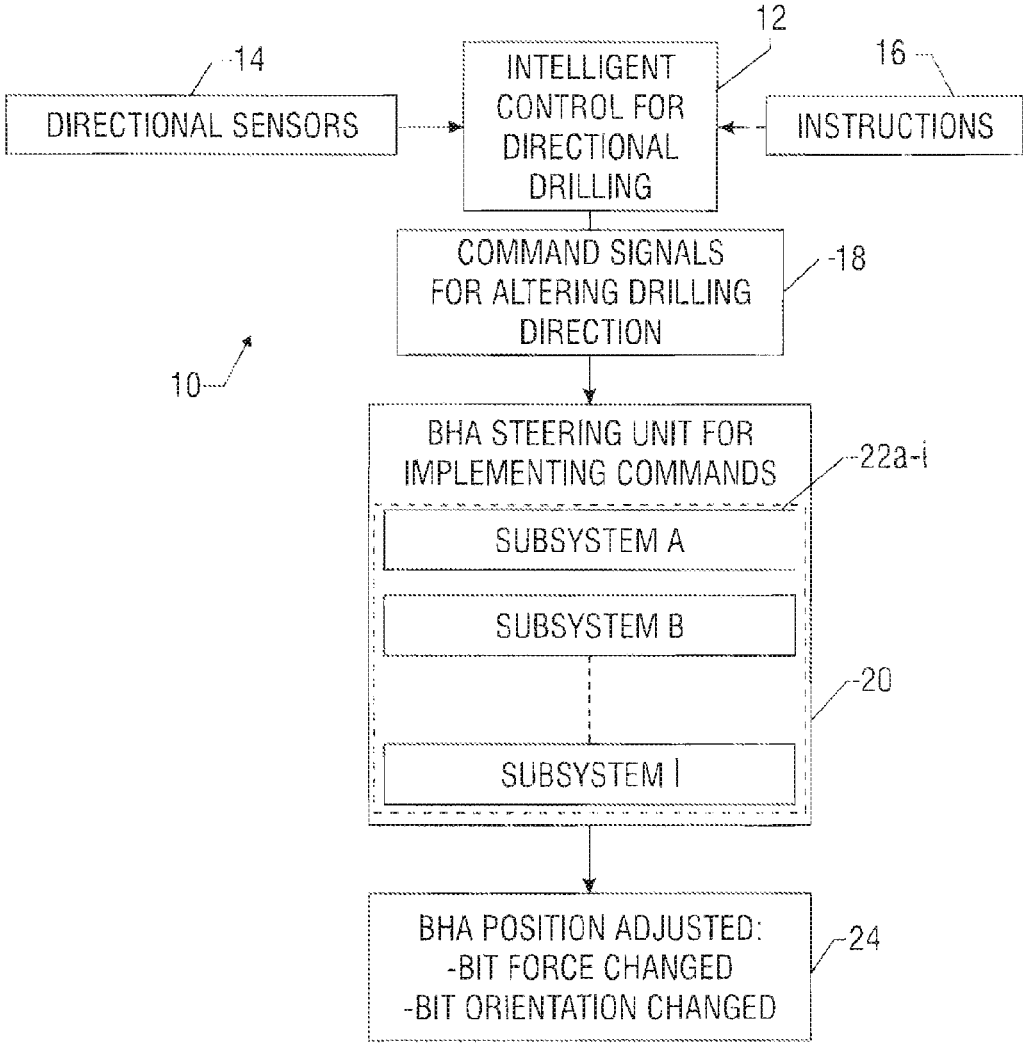
FIG. 1 (Prior Art)
FIG. 1 illustrates a flow chart for a control method and system for directional drilling using a conventional rotary steerable drilling system.

In one aspect, the present invention relates to devices and methods utilizing smart materials for steerable systems, devices and methods for drilling complex curvature directional wellbores. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Figure 2:
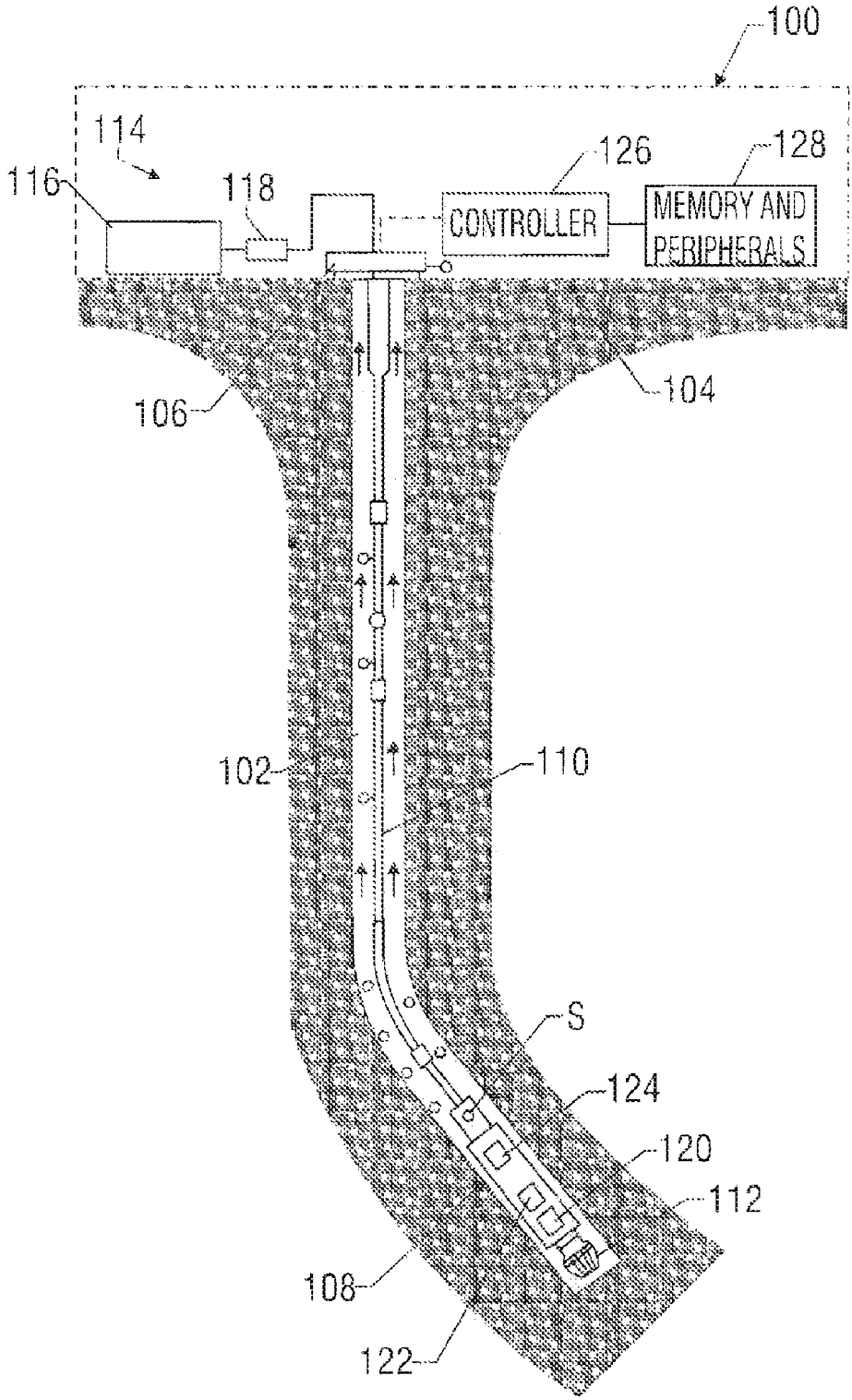
FIG. 2 is a schematic illustration of one embodiment of a drilling system for directional drilling of a wellbore.

Referring initially to FIG. 2, there is schematically illustrated a system 100 for performing one or more operations related to the construction, logging, completion or work-over of a hydrocarbon producing well. In particular, FIG. 2 shows a schematic elevation view of one embodiment of a wellbore drilling system 100 for directionally drilling a wellbore 102. The drilling system 100 is a rig for land wells and includes a drilling platform 104, which may be a drill ship or another suitable surface workstation such as a floating platform or a semi-submersible for offshore wells. For offshore operations, additional known equipment such as a riser and subsea wellhead will typically be used. Further, the wellbore drilling system 100, while described below as a conventional flow system, can be readily adapted to reverse circulation (i.e., wherein drilling fluid is conveyed into an annulus and returned via the drill string). To drill a wellbore 102, well control equipment 106 (also referred to as the wellhead equipment) is placed above the wellbore 102.

This system 100 further includes a well tool such as a drilling assembly or a bottomhole assembly ("BHA") 108 at the bottom of a suitable umbilical such as drill string or tubing 110 (such terms will be used interchangeably). In one embodiment, the BHA 108 includes a drill bit 112 adapted to disintegrate rock and earth. The bit 112 can be rotated by a surface rotary drive, a downhole motor using pressurized fluid (e.g., mud motor), and/or an electrically driven motor or combinations thereof. The tubing 110 can be formed partially or fully of drill pipe, metal or composite coiled tubing, liner, casing or other known members. Additionally, the tubing 110 can include data and power transmission carriers such as fluid conduits, fiber optics, and metal conductors. Sensors S are disposed throughout the BHA to measure drilling parameters, formation parameters, and BHA parameters.

During drilling, a drilling fluid from a surface mud system 114 is pumped under pressure down the tubing 110. The mud system 112 includes a mud pit or supply source 116 and one or more pumps 118. In one embodiment, the supply fluid operates a mud motor in the BHA 108, which in turn rotates the drill bit 112. The drill string 110 rotation can also be used to rotate the drill bit 112, either in conjunction with or separately from the mud motor. The drill bit 112 disintegrates the formation (rock) into cuttings that flow uphole with the fluid exiting the drill bit 112.

The BHA 108 includes a steering unit 120 and a control unit 122. The BHA 108 can also include a processor 124 in communication with the sensors S, the control unit 120 and/or a surface controller 126 and peripherals 128. The sensors S can be configured to measure formation parameters (e.g., resistivity, porosity, nuclear measurements), BHA parameters (e.g., vibration), and drilling parameters (e.g., weight on bit 112). In certain embodiments, the steering unit 120 and control unit 122 (with or without control signals from the surface) provide dynamic control of bit 112 orientation to influence borehole curvature and direction. The steering unit 120 utilizes a fast response "smart" material, described more fully below, coupled with directional drilling assemblies. It is believed that using smart material controlled in an active manner will allow control and change/response of the steering head system configuration at speeds not feasible with conventional electro-hydraulic-mechanical systems. It is further believed that this step change in system control and response speed will allow the steering head to become an integral part of the rotating assembly and allow shaft or drill string rotations speeds greater than conventional rotary steering systems integrated into a rotating assembly will allow.

Figure 3:
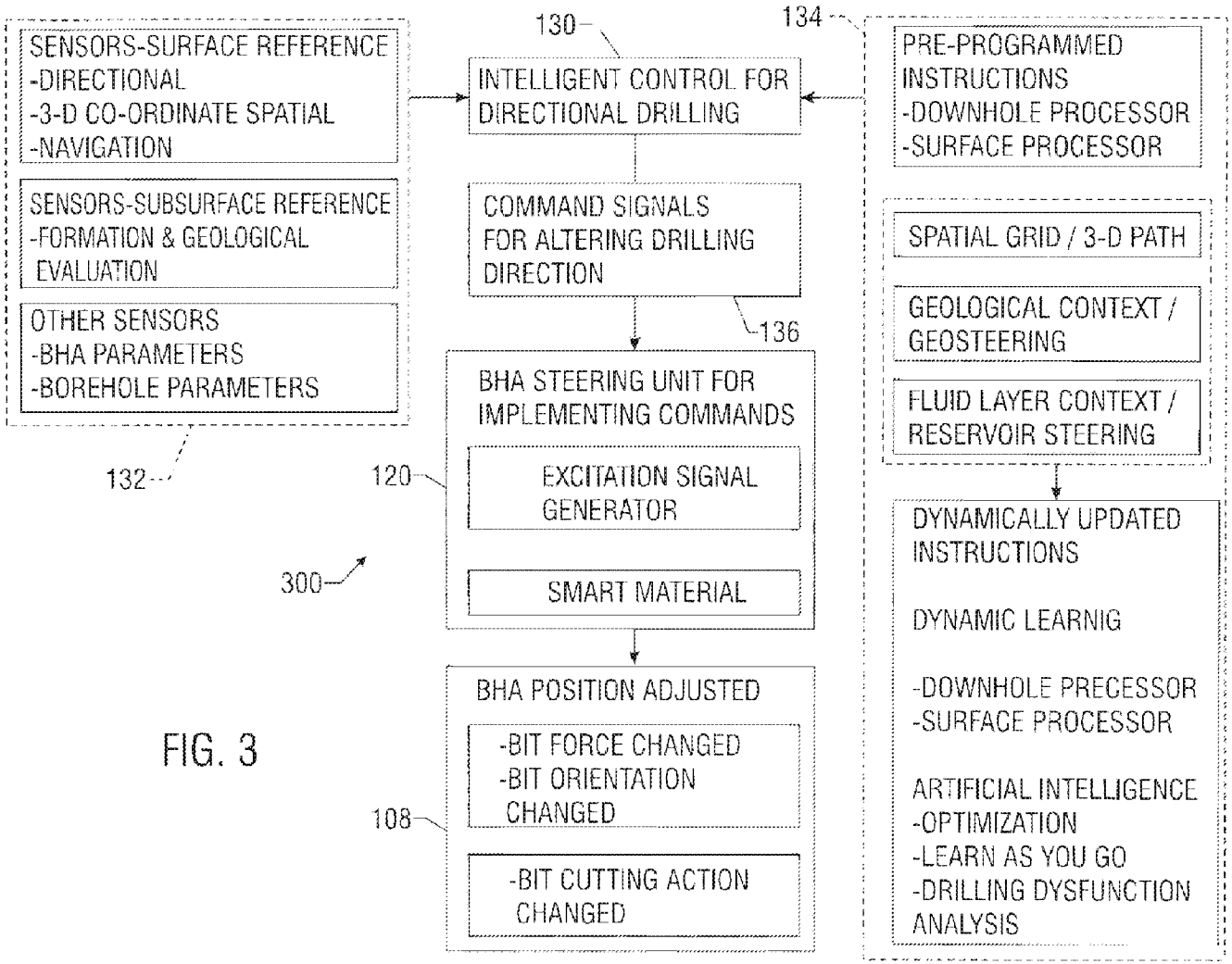
FIG. 3 illustrates a flow chart for a directional drilling control method and system that is made in accordance with the present invention.

Referring now to FIGS. 2 and 3, a control system 130 for controlling a steering unit 120 made in accordance with one embodiment of the present invention is shown. The control system 130 receives measured data 132 (which can be one or more parameters of interest), which in conjunction with instructions 134 (pre-programmed or dynamically updated), is used to determine appropriate command signals 136 that are transmitted to the steering unit 120. In one embodiment, the measured data 132 can include data used in relation to a fixed reference point, such as the surface. Such data can include the three-dimensional orientation of the BHA 108 in the wellbore 102. This data can include azimuth, inclination and depth data. The measured data 132 can also include data that characterizes the formation in the vicinity of the BHA 108 such as porosity, resistivity, etc. Still other measured data 132 can include data that can be used to evaluate the health and efficiency of the BHA 108 as well as data indicative of the wellbore environment such as wellbore pressure and temperature. The control unit 130 uses the measured data 132 to determine the appropriate adjustments to the BHA 108 for more accurate wellbore placement and positioning and enhanced drilling efficiency and BHA health. This determination is based at least in part on the instructions 134. The instructions, in one aspect, can be static and provide a specific wellbore trajectory that is to be followed by the BHA 108. In another aspect, the instructions can be revised based on learned experience; i.e., updated periodically based on optimization techniques, prescribed operating parameters, dynamic drilling models, and in response to measured data. Thus, for example, the instructions 134 can periodically adjust the drilling direction to be followed based on measurements gathered regarding a particular geological formation and/or reservoir.

The appropriate drilling direction can be determined in reference to a pre-defined well path, a well path adjusted to reflect revised down hole reservoir information, a well path revised from the surface, and/or a well path revised relative to marker limit spacing. After this determination, the control unit 130 computes the necessary adjustments to be made to the BHA 108 to effect the new drilling direction and transmits via a suitable telemetry system (not shown) the corresponding command or control signals 136 to the steering unit 120.

In response to the command signal 136, an excitation signal/field generator produces an appropriate excitation signal/field. The generator can be a conductor, a circuit, a coil or other device adapted produce and/or transmit a controlled energy field. The excitation signal/field causes a controlled material change (e.g., rheological, dimensional, etc.) in an appropriately formulated material, hereafter "smart" material. Smart materials include, but are not limited to, electrorheological fluids that are responsive to electrical current, magnetorheological fluids that are responsive to a magnetic field, and piezoelectric materials that responsive to an electrical current. This change can be a change in dimension, size, shape, viscosity, or other material property. The smart material is deployed such that a change in shape or viscosity can alter system geometry, apply side forces, and/or vary the cutting action by the bit face to thereby control drilling direction of the drill bit 112. Additionally, the "smart" material is formulated to exhibit the change within milliseconds of being subjected to the excitation signal/field. Thus, in response to a given command signal, the requisite field/signal production and corresponding material property can occur within a few milliseconds. Thus, hundreds of command signals can be issued in, for instance, one minute. Accordingly, command signals can be issued at a frequency in the range of rotational speeds of conventional drill strings (i.e., several hundred RPM).

Illustrative embodiments of steering units employing smart materials are discussed below in the context of steering units configured to controlling direction by changing the geometry of a BHA ("system geometry change tools"), by generating a selected bit force vector ("force vector systems"), and by controlling the cutting action of the bit 112 ("differential cutting systems"). It should be appreciated, however, that the teachings of the present invention are not limited to the described embodiments nor their representative systems.

System Geometry Change Steering

System geometry change steering units effect a change in drilling direction by influencing the way the bit 112 and bottom hole assembly 108 lays in the previously drilled hole so as to influence the tilt of the bit 112. The end effect is that the bit face points or tilts in a selected orientation for the selected new direction of the hole. For steering units utilizing system geometry change, the act of pointing (through flexure) or tilting (via a hinged joint) the bit 112 generally causes the lower end of the drilling assembly 108 to have a tool assembly centerline that is different from that of the previously drilled hole. This variable tool centerline will occur above and below the point of tilt or area of flexure (can be non-linear) and will be continuous although slope discontinuities within the mechanical assembly may occur. Methods and arrangements for pointing or tilting of the bit face can utilize "composite geometry change" and "local geometry change," both of which are described below.

Figure 4:
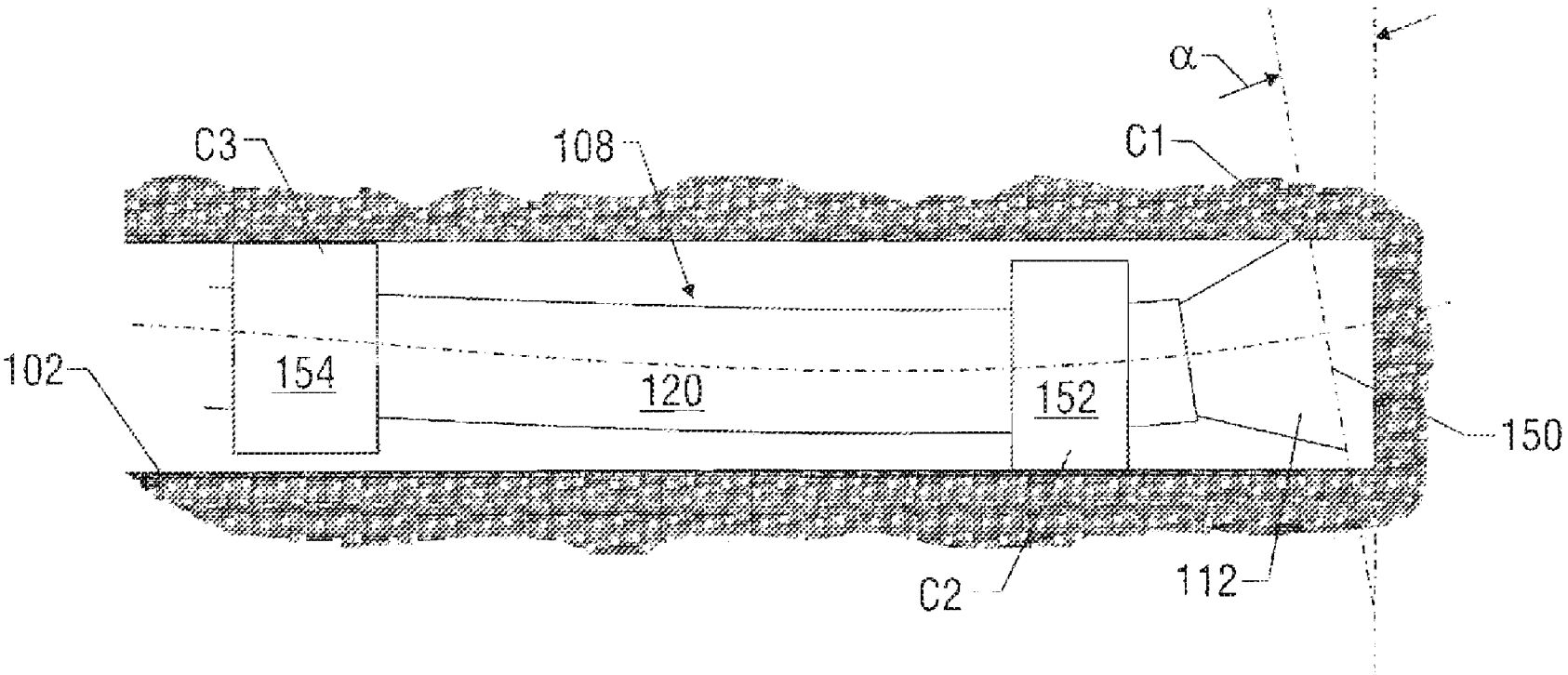
FIG. 4 schematically illustrates one embodiment of a system geometry change steering unit made in accordance with the present invention.

Referring now to FIG. 4, there is shown a steering unit 120 adapted to steer a BHA 108 using composite geometry change. The steering unit 120 changes the pointing of the bit face 150 of the bit 112 by introducing bending stresses in the BHA 108 above the bit 112 to change a bit face tilt angle α. The BHA 108 is shown in the wellbore 102 as having three points of contact: a contact point C1 at the bit 112, a contact point C2 at a stiffener 152 behind the bit 112, and either a top hole stiffener 154 or the point where the BHA 108 flexes to lay along a side of the wellbore 102 as contact point C3. The steering unit 120 induces a bending moment between contact points C2 and C3 that causes a pointing of the bit face 150 (contact point C1) in a selected direction. Stiffeners 152, 154, which act merely as a relatively rigid attachment point, can be a separate element or formed integral with a drill string or the BHA 108 (e.g., a flange).

Figure 5B:
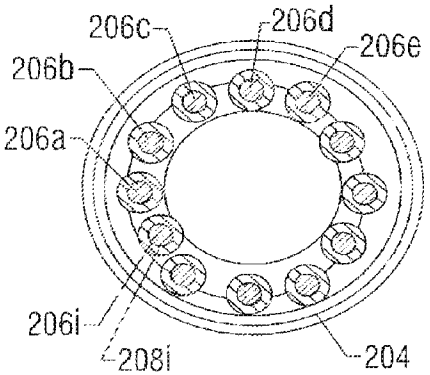
FIG. 5B schematically illustrates an end view of the FIG. 5A embodiment.
Figure 5A:
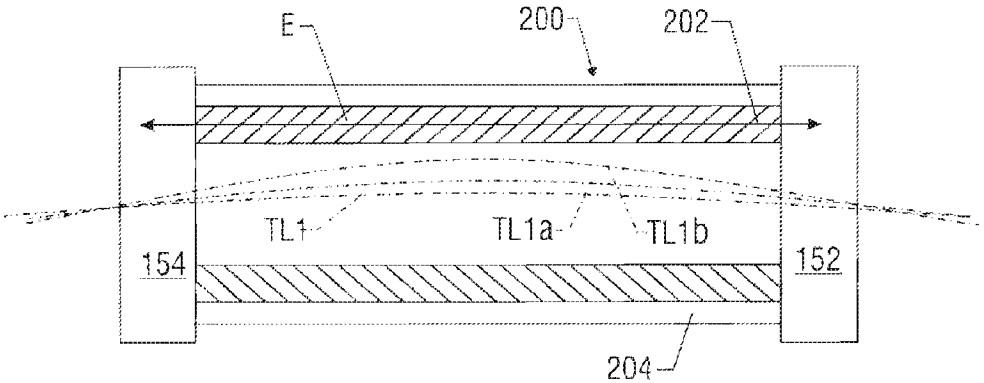
FIG. 5A schematically illustrates one embodiment of deformable sleeve for a steering unit made in accordance with the present invention.
Figure 5D:
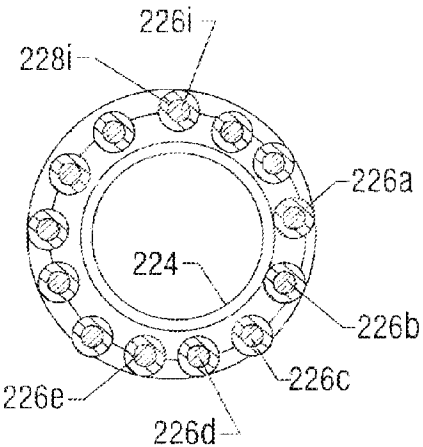
FIG. 5D schematically illustrates an end view of the FIG. 5C embodiment.
Figure 5C:
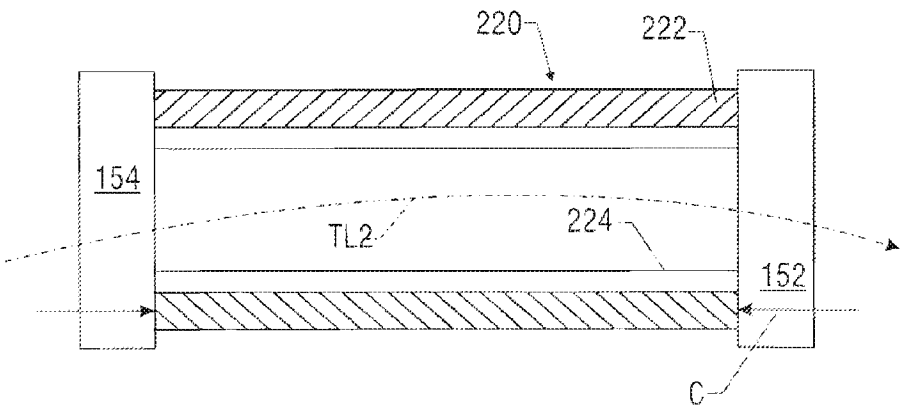
FIG. 5C schematically illustrates another embodiment of deformable sleeve for a steering unit made in accordance with the present invention.

Referring now to FIG. 5A-D, there are shown embodiments of a geometry change steering unit that includes a deformable sleeve. Merely for ease of explanation, the embodiment of FIGS. 5A-B depict a sleeve that expands when subjected to an excitation signal and FIG. 5C-D depict a sleeve that contracts when subjected to an excitation signal. As will be discussed below, other embodiments can include a sleeve configured to expand or contract depending on the excitation signal. Still other embodiments can include a sleeve having some elements that expand when subjected to an excitation signal or other elements that contract when subjected to an excitation signal. It should be understood, however, that these described embodiments are merely illustrative and that the teachings of the present invention are not limited to the described embodiments.

Referring now to FIG. 5A-B, in one embodiment, a geometry change steering unit 200 includes a deformable sleeve 202 between stiffeners 152 and 154. The sleeve 202 is formed at least partially of one or more smart materials that expand longitudinally (shown with arrow E) when subjected to an excitation field/signal. In one embodiment, a tube 204 is configured to carry the compressive and tensional loads for drilling (e.g., a "rigid" tube) and acts as a housing for the sleeve 202. The sleeve 202 is disposed inside the tube 204 and includes a plurality of longitudinal ribs or tendons 206*a-i* running the length of the rigid tube 204. The tendons 206*a-i* are fixedly attached to the stiffeners 152 and 154 to form classic 'bone and tendon network'. The tendons 206*a-i* can also attach to the tube 204 at other locations and by other suitable methods (e.g., chemical bond, fasteners, weld, etc.) A signal/field generating device 208*i* produces an excitation signal that causes the tendons 206*a-i* to react in a predictable manner. In certain embodiments, the signal/field generating device 208*i* is an EMF flow circuit where EMF potential difference is controlled and modulated. As shown, each tendon 206*a-i* has an associated signal/filed generation device 208, but other (e.g., shared) arrangements can also be used in certain applications. In this embodiment, the smart material performs in an expansion mode. That is, by actively controlling the applied excitation field (e.g., electrical field), one or more selected ribs or tendons (e.g., ribs 206*c-e*) are caused to expand against the stiffeners 152 and 154 that are fixed to the rigid tube 204. Under this applied force, the rigid tube 204 flexes or curls in the opposite direction of the expanded ribs or tendons 206*c-e*. This has the net effect of bending or changing the composite geometry of the BHA 108 proximate the bit 112 (FIG. 4). An exemplary composite geometry tool center line produced by the steering unit 200 is shown as tool center line TL1.

Referring now to FIG. 5C-D, there is shown another embodiment of a geometry change steering unit 220 that also includes a deformable sleeve 222 between stiffeners 152 and 154. The sleeve 222 is formed at least partially of one or more smart material that contracts longitudinally (shown with arrow C) when subjected to an excitation field/signal. In one embodiment, a tube 224 is configured to carry the compressive and tensional loads for drilling (e.g., a "rigid" tube) and acts as a housing for the sleeve 222. The sleeve 222 is disposed outside of the tube 224 and includes a plurality of longitudinal ribs or tendons 226*a-i* running the length of the rigid tube 224. The tendons 226*a-i* are fixedly attached to stiffeners 152 and 154 to form classic 'bone and tendon network'. The tendons 226*a-i* can also attach to the tube 224 at other locations and by other suitable methods (e.g., chemical bond, fasteners, weld, etc.). A signal/filed generation device 228*i* or other device produces an excitation signal that cause the tendons 226*a-i* to react in a predictable manner. As shown, each tendon 226*a-i* has an associated signal/filed generation device 228, but other (e.g., shared) arrangements can also be used in certain applications. In this embodiment, the smart material performs in a contraction mode. That is, by actively controlling the excitation field (e.g., EMF, electrical field) produced by the signal/filed generation devices 228, one or more selected ribs or tendons (e.g., ribs 226*c-e*) are caused to contract and effective pull together the stiffeners 152 and 154 that are fixed to the rigid tube 224. Under this applied force, the rigid tube 224 flexes or curls in the direction opposite of the shortened ribs or tendons 226*c-e*. This has the net effect of bending or changing the composite geometry of the BHA 108 proximate the bit 112 (FIG. 4). An exemplary composite geometry tool center line produced by the steering unit 220 is shown as tool center line TL2.

It should be understood that the embodiments described in FIGS. 5A-D (as well as those described below) can include elements for expanding and contracting portions of the rigid tube 204. Thus, for instance, one element 206*a* can expand and another element 206*i* that is oppositely aligned can contract to bend rigid tube 204. In certain applications, a first excitation signal can cause an element 206*i* to contract and a second excitation signal can cause the element 206*i* to expand. In other applications, the elements 206*a-i* are formulated to either contract or expand when subjected to an excitation signal. Thus, the sleeve 202 can include one set of elements configured to expand and another set of elements configured to contract.

Figure 5F:
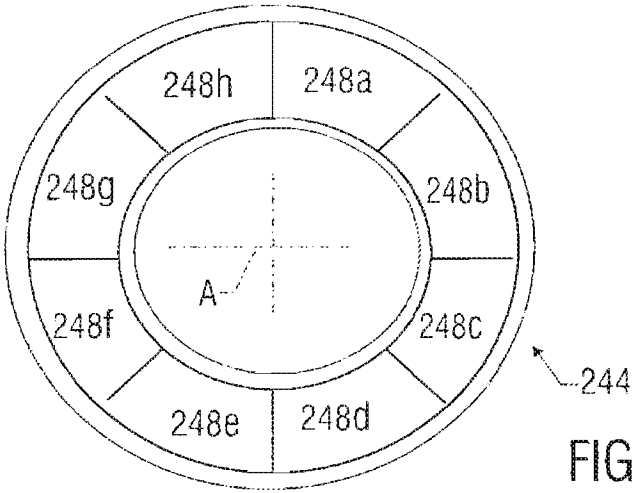
FIG. 5F schematically illustrates an end view of the FIG. 5E embodiment.
Figure 5E:
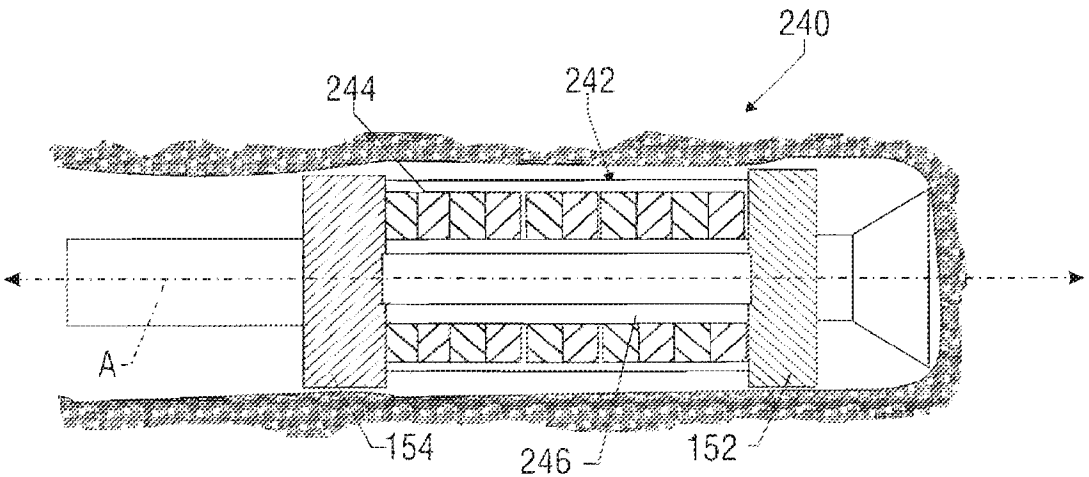
FIG. 5E schematically illustrates an embodiment of deformable sleeve having one or more washers for a steering unit made in accordance with the present invention.

Referring now to FIG. 5E-F, there is shown another embodiment of a geometry change steering unit 240 that also includes a deformable sleeve 242 between stiffeners 152 and 154. The sleeve 242 includes a plurality of axially arranged rings or washers 244 disposed inside or outside of a rigid tube 246. Each washer 244 includes a plurality of circumferentially arrayed deformable elements 248*a-h*. The elements 248*a-h* are formed of smart material that deform (e.g., expand or contract) along the longitudinal axis A when subjected to an excitation signal, such as an electrical impulse, transmitted via suitable conductors or coils (not shown) from the control unit (not shown). The elements 248*a-h* can be formed to deform from a steady-state shape or geometry (e.g., width or length). The selective excitation of the elements 248*a-h* in the same sector of each washer can produce a combined tension or compression along the rigid tube such that the tube bends in a controlled manner. In certain embodiments, a tension can be produced in one sector and a compression in a different sector.

In certain embodiments, the smart materials are configured to provide a material change that is proportional to a selected parameter of the excitation signal (i.e., the strength, intensity, magnitude, polarity, etc.). Referring now to FIG. 5*a-b*, merely by way of illustration, the elements 206*a-i* can be configured to expand or lengthen an amount proportional to the intensity of the excitation signal. For instance, in response to a low intensity excitation signal, the elements 206*a-e* expand to a first length to cause a tool center line deflection TL1 for the rigid tube 204. In response to a medium intensity excitation signal, the elements 206*a-e* expand to a second length to cause a tool center line deflection TL1*a* for the rigid tube 204. In response to a high intensity excitation signal, the elements 206*a-e* expand to a third length to cause a tool center line deflection TL1*b* for the rigid tube 204. There need not be a step-wise correlation between the controlled parameter of the excitation signal and the response of the smart material. Rather, the response of the smart material to the selected parameter of the excitation signal can be of a sliding scale fashion. Also, the response of the smart material can vary directly or inversely with a selected parameter of the excitation signal.

The above described composite steering units can be in a lower section of a rotary drill string BHA 108, in a component of a bearing housing in a modular or conventional drilling motor assembly (not shown), or other suitable location sufficiently proximate to the bit 112.

Figure 6A:
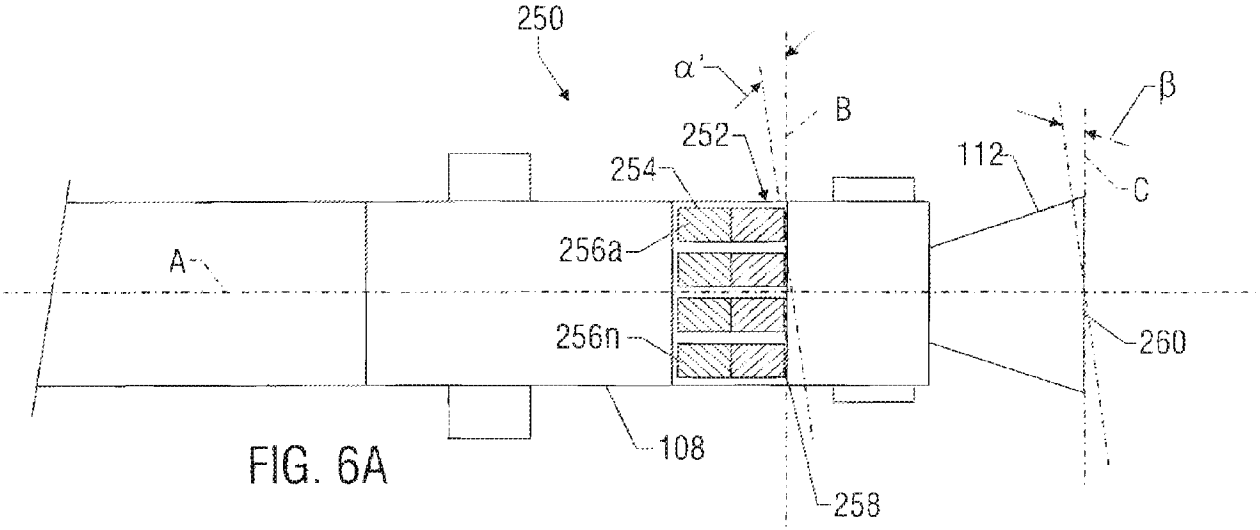
FIG. 6A schematically illustrates one embodiment of a local geometry change steering unit made in accordance with the present invention.
Figure 6B:
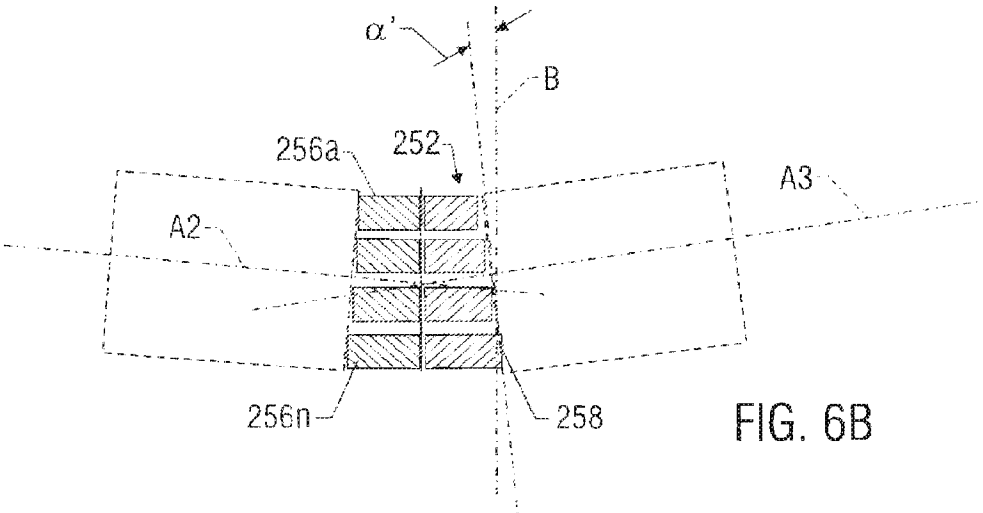
FIG. 6B schematically illustrates the FIG. 6A embodiment effecting a local geometry change.

Referring now to FIGS. 6A-B, there is shown a steering unit 250 that utilizes a local geometry change (i.e., a discontinuity in slope of tool centerline) to change the direction the bit 112 is pointing. In one embodiment, the steering unit 250 includes a dynamically adjustable articulated hinge or joint 252 that, when actuated, can adjust the orientation of the bit 112. The articulated joint 252 can be positioned immediately adjacent to the bit 112 or disposed in the BHA 108. In one embodiment, the articulated joint 252 includes a washer or ring 254 having a plurality of elements 256*a-n* that can individually or collectively deform (expand or contract) along a longitudinal axis A of the BHA 108. An exemplary washer arrangement has been previously described in reference to FIGS. 5E-F. This controlled longitudinal deformation alters the physical orientation of a face 258 of the ring 254. For instance, one or more of the elements 256*a-n* can expand to produce thrust that acts against a bearing surface of an adjacent structure (e.g., a sub, thrust bearing, stabilizer, load flange, etc.). This action causes a discontinuity between a tool center line uphole A2 of the joint 252 and a tool center line downhole A3 of the joint 252.

It should be appreciated that the elements operate effectively as an adjustable joint that allows the steering unit to flex or bend (e.g., assume a bend radius). Merely for illustrative purposes, there is shown element 256*n* expanded (and/or element 256*a* contracted) to produce a tilt of angle $\alpha'$ from a reference plane B for a ring face 258. This angle $\alpha'$ provides a corresponding tilt for the bit 112 such that a bit face 260 tilts a corresponding angle $\beta$ from a reference plane C. The term "tilt" refers merely to a displacement or shift of position from a previous position or a nominal/reference position. The displacement can be longitudinal, radial, and in certain instances rotational, or combinations thereof. Moreover, the displacement need not be parallel or orthogonal to any particular reference plane or axis. It should be understood that a tilt can also be produced by expanding elements 256*a* and 256*n* in different amounts, contracting elements 256*a* and 256*n* in different amounts, or expanding/contracting element 256*a* while having element 256*n* remain static. That is, the slope of the face 258 may be controlled by variation of the energizing field strength for the smart material. Thus the degree of the tilt change for the bit face 260 may be not just turned on or off, it may be tuned and adjusted for aggressiveness and rate of hole angle direction change. By selectively energizing segments 256*a-n*, a counter rotation is simulated for the ring face 258 at a speed similar to the bit 112. The simulated counter-rotation effectively cancels the actual rotation of the bit 112 (or other rotating member) such that the deflection always points (tilts) the bit 112 in a selected direction and thus actively control directional behavior of the well path. Referring also to FIGS. 4 and 6A, the smart material washer or ring 254 may be placed between contact points C2 and C3 to cause a rocking tilt change out on the bit 112 at contact point C1.

Figure 6C:
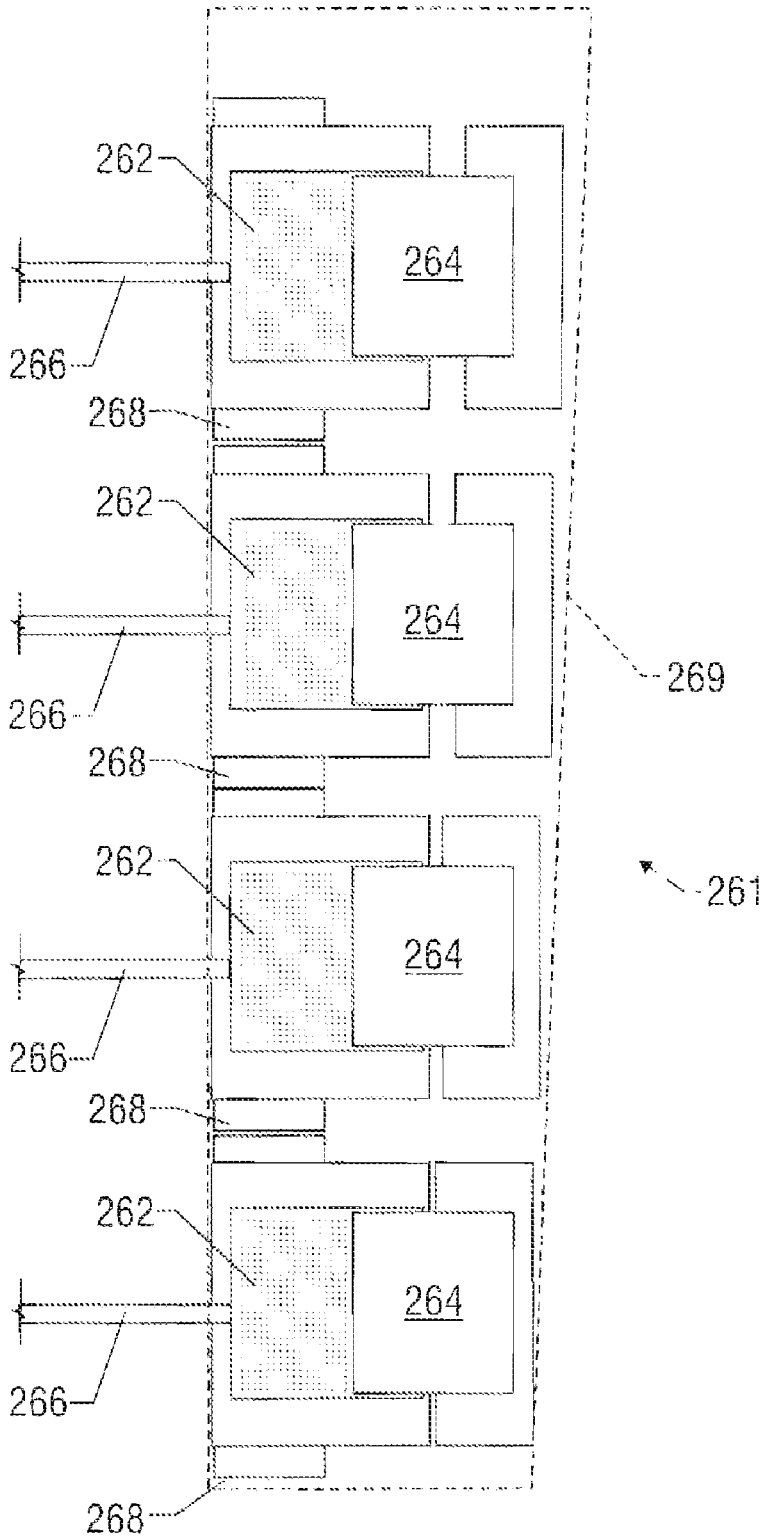
FIG. 6C schematically illustrates an embodiment of a steering unit made in accordance with the present invention that utilizes a smart fluid.

Referring now to FIG. 6C, there is shown another embodiment of an arrangement for producing dynamic tilting of a bit 112 (FIG. 6A) that wherein a joint 261 includes a plurality of hydraulic chambers 262 filled with a smart fluid (e.g., a fluid having variable-viscosity) and associated pistons 264. In one application, the smart fluid provides increased or decreased resistance to compression when subjected to an excitation signal, such as an electrical impulse. Thus, application of an excitation signal causes, for example, the fluid within the chamber to allow the piston 264 to slide into the chamber 262. A conduit 266 can provide communication between the fluid in the chamber 262 and a separate reservoir (not shown) and/or convey the excitation signal from a controller (not shown) to the chamber fluid. In other embodiments, one or more excitation signal/field generators 268 can be positioned proximate the chamber 262. Thus, in this embodiment, the pistons 264 individually or collectively contract or relax when subjected to the forces inherent during drilling (e.g., weight on bit 112). Because selective activation of the smart fluid causes the pistons 264 to compress in different axial amounts, the face 269 of the joint 261 tilts. This tilt thereby alters the physical orientation of the drill bit 112. It should be appreciated that a plurality of serially arranged piston-cylinders can be utilized to provide a composite geometry change.

Figure 7:
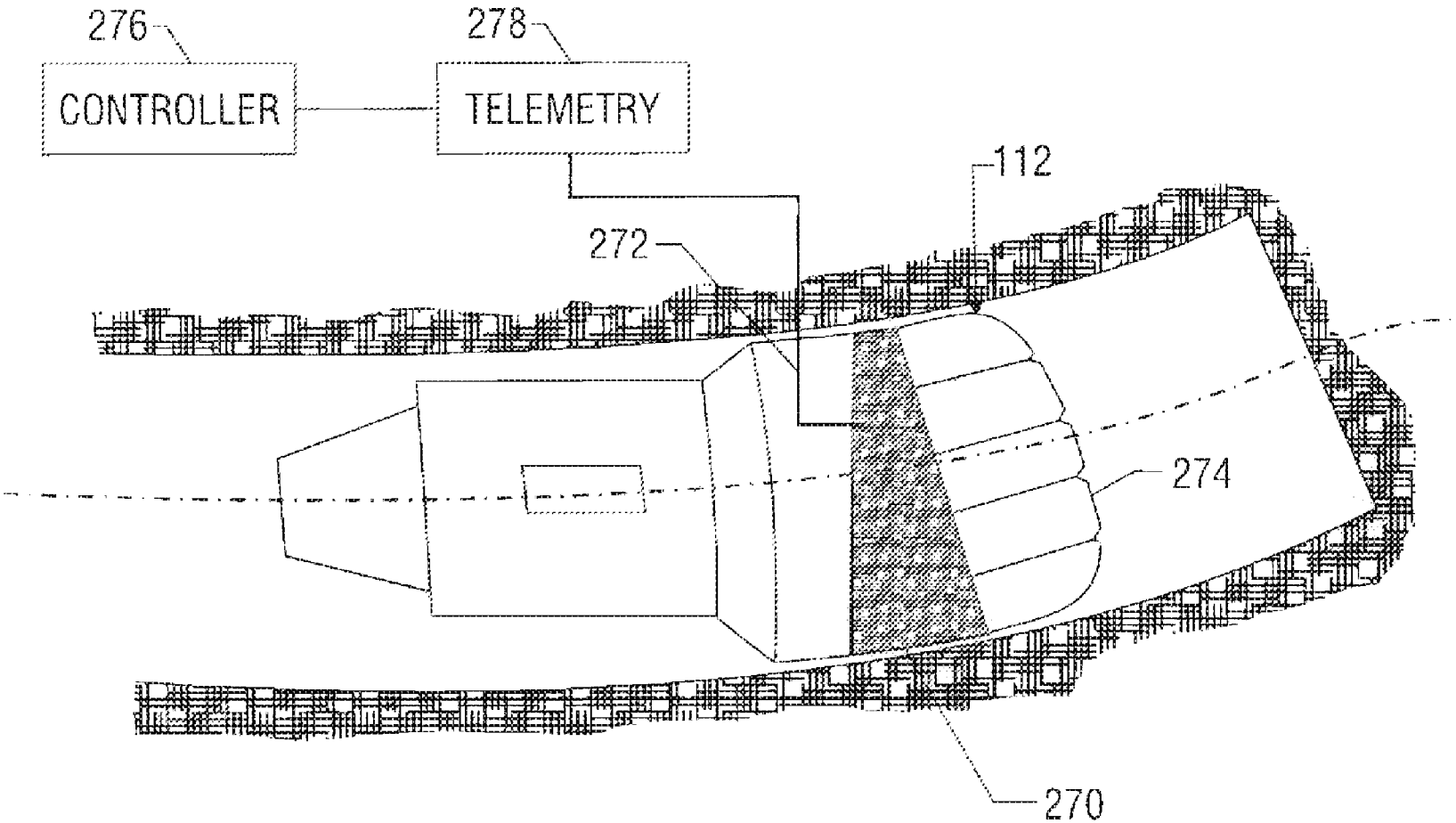
FIG. 7 schematically illustrates one embodiment of a local geometry change steering unit provided on a drill bit.

Referring now to FIG. 7, in still another embodiment, a washer 270 utilizing smart materials can be incorporated directly into a body 272 of the drill bit 112 and placed in close proximity to the bit face 274. A controller 276 communicates with the washer 270 via a short hop telemetry system 278 to control the excitation signals provided to the smart material used by washer 270 by a suitable generator (not shown). The telemetry system can also include hard wiring, inductive coupling or other suitable transmission devices.

Force Vector Change Steering Unit

Figure 8:
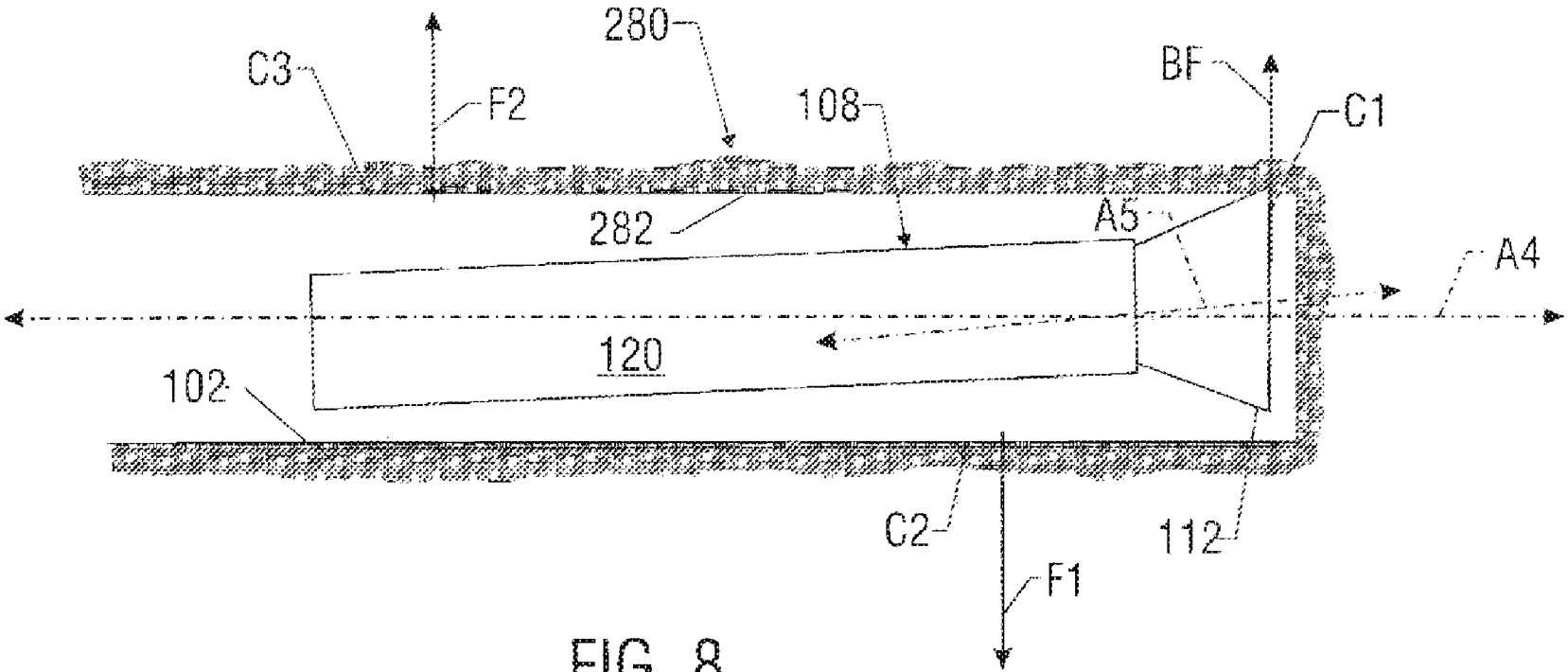
FIG. 8 schematically illustrates one embodiment of a force vector change steering unit made in accordance with the present invention.

Referring now to FIG. 8, there is shown an exemplary steering unit 280 that utilizes force vectors to produce a bit force BF at the bit 112 to result in side cutting and a change in well bore path and direction. This bit force BF at the bit 112 can be caused by moving the centerline of rotation for contact point C2 off the centerline A4 of the well bore 102. As shown in FIG. 8, the eccentricity of the tool centerline of rotation towards a high side 282 of the well bore 102 causes a bending stress that results in a high side bit force BF for the drill bit 112 (contact point C1). The bit 112 is 'forced' into the high side by the bending stress within the deflected steering head assembly 280 caused by the offset of the centerline A5 of tool rotation at contact point C2. The bit 112 tends to preferentially cut where it is forced (the side of the hole) and a change in direction of the well path results. The manipulation of vector forces can be applied to rotary or motor drilling BHAs.

Figure 9B:
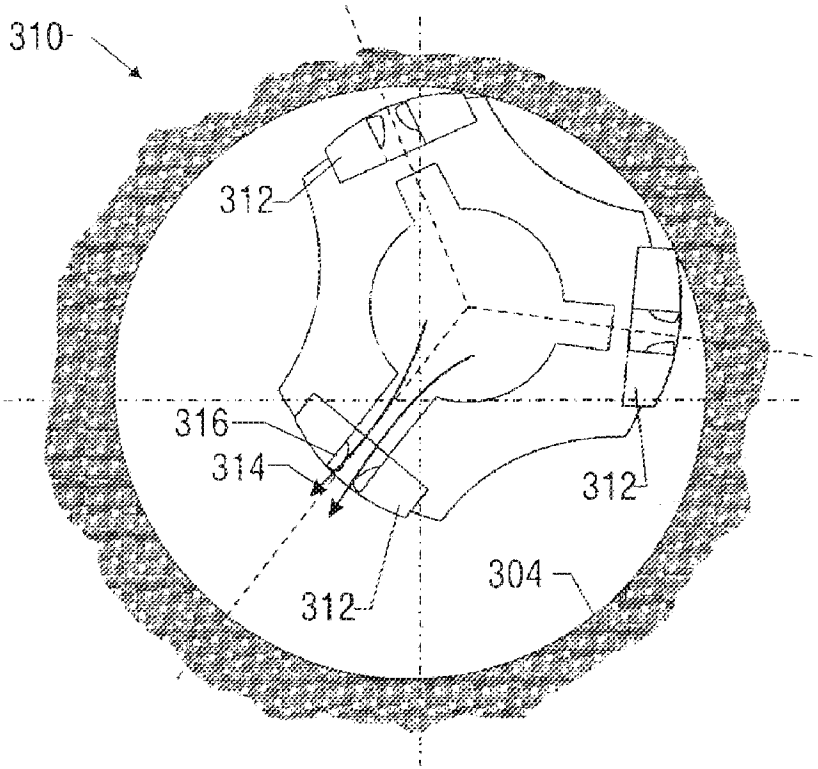
FIG. 9B illustrates a one embodiment of a force vector change steering unit made in accordance with the present invention that utilizes a stabilizer producing hydraulic jets modulated by a smart material.
Figure 9A:
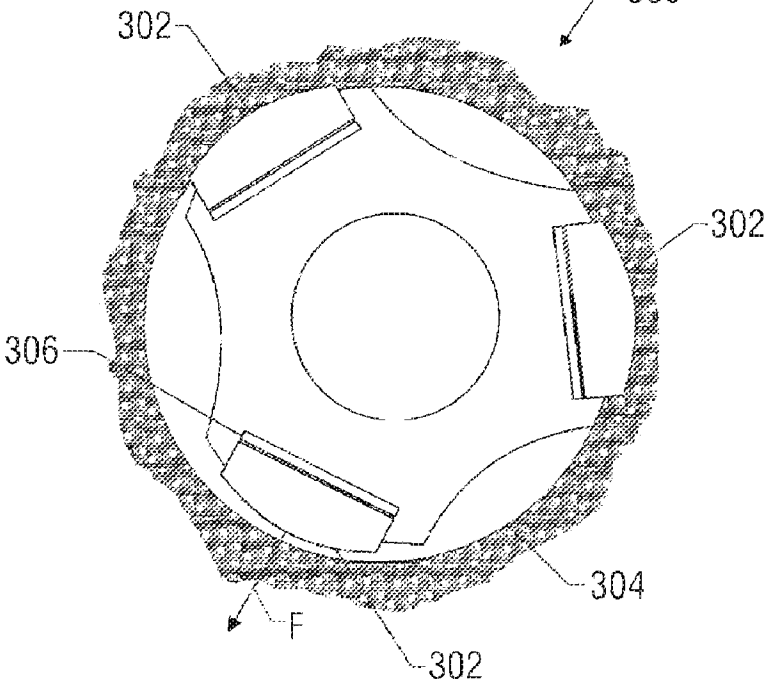
FIG. 9A illustrates a one embodiment of a force vector change steering unit made in accordance with the present invention that utilizes a stabilizer having pads actuated by a smart material.

Referring now to FIGS. 8 and 9A, there is shown an embodiment of the present invention wherein a stabilizer 300 utilizing smart materials is configured to produce/adjust bit side force BF. The stabilizer 300 is fixed to a rotating section of the BHA 108. The stabilizer 300 includes a plurality of force pads 302 for applying a force F against a borehole wall 304. In this embodiment, steering is effected by force vector F, which creates a reaction force that urges the bit 112 in the direction generally opposite to the force vector F. In one embodiment, the stabilizer 300 can be used at contact point C2 to produce a force F1 that causes bit force BF. The force pads 302 are actuated by a shape change material 306 that deform in response to an excitation signal produced by a signal/filed generation device or other suitable generator (not shown) as discussed earlier. The expansion/contraction of the shape change material extends or urges the force pads 302 radially outward and/or outward. A controller (not shown) communicates with the stabilizer 300 to control the operation of the force pads 302. The stabilizer 300 can be positioned as close as possible to the bit 112 to maximize the leverage provided by the extended pads 302.

Referring now to FIGS. 8 and 9B, there is shown another embodiment of the present invention wherein a stabilizer 310 is fixed to a rotating section of the BHA 108. The stabilizer 310 includes a plurality of nozzles 312 that form hydraulic jets 314 of pressurized drilling fluid. As noted earlier, pressurized drilling fluid is pumped downhole via the drill string 110 during drilling. The nozzles 312 use a smart material along the fluid exit path to selectively regulate the flow of exiting fluid. For example, the smart material 314 that is disposed in a valve can expand to reduce the cross-sectional flow path to restrict or stop the flow of drilling fluid. Thus, the strength of the hydraulic jets 314 can be controlled via a signal/field generator (not shown) to produce reactive forces. The hydraulic jets 314 produce reactive forces that shift the centerline of rotation away from the center of the well bore analogous to all actions discussed with reference to FIG. 9A. Controlling the hydraulic jet 314 velocity/flowrate can alter the symmetry of the lateral hydraulic force vectors and thus control the direction of the lateral deflection in a manner quite similar to mechanical pushing against the well bore wall 304.

In certain embodiments, the stabilizers 300 and 310 can be placed at either contact points C2 or C3. In other embodiments, the stabilizers 300 and 310 can be deployed at C2 and C3. In such embodiments, the stabilizers 300 and 310 can be operated to produce opposite but axially spaced apart reaction forces (e.g., F1 and F2).

Figure 10:
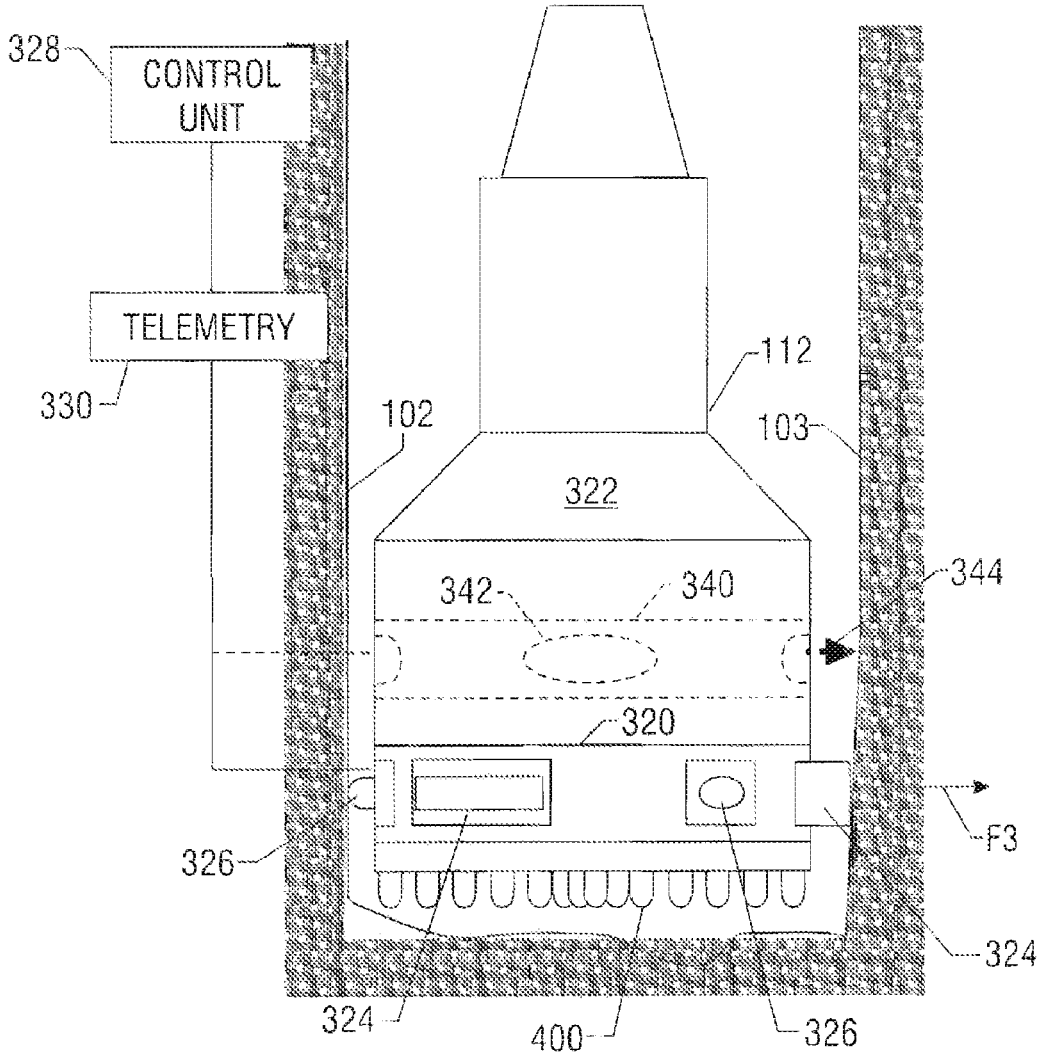
FIG. 10 illustrates an exemplary drill bit provided with a steering unit made in accordance with the present invention.

Referring now to FIG. 10, there is an embodiment of the present invention wherein a deflection device 320 is fixed to a bit 112 to manipulate the radial positioning of the bit 112 relative to the wellbore 102. The drill bit 112 has a bit body 322 adapted to receive the deflection device 320. The deflection device 320 includes a plurality of force pads 324 for applying a force F3 against a borehole wall 103 and gage cutters 326 for cutting the borehole wall 103. The force pads 324 and gage cutters 326 are actuated by a shape change material that expands/contracts in response to an excitation signal as discussed earlier. The expansion/contraction of the shape change material moves or urges the force pads 324 and gage cutters 326 radially. In this embodiment, steering is effected by force vector F3, which creates a reaction force urges the bit 112 in the direction generally opposite to the force vector F3. The action of the gage cutters 326 and force pads 324 are coordinated such that when a force pad 324 extends out, the corresponding cutter 326 on the opposite side also extends out to cut the borehole wall. A controller 328 communicates with the deflection device 320 via a short hop telemetry system 330 to control the operation of the force pads 324 and gage cutters 326. In other arrangements, the deflection device 320 includes only force pads 324. Thus, the deflection device 320 can dynamically adjust the center of rotation for the bit 112, the direction in which the bit 112 is 'pushed' and the aggressiveness of gage cutting structure in a synchronous action. Furthermore, a hydraulic deflection device 340, shown in phantom, can be used in lieu of or in addition to the deflection device 320. The hydraulic deflection device 340 uses smart material controlled nozzles 312 along the outer diameter of the bit 112 to produce controllable hydraulic jets 344 to facilitate the same actions denoted above with respect to FIG. 9B. Data, command signals, and power can also be transmitted to the deflection device 320 via a hard wiring, inductive coupling or other suitable transmission devices and systems.

While FIG. 10 illustrates a fixed cutter style bit, the above described method and arrangement can also be adapted to other styles of bits, including, but not limited to, roller cone bits, winged reamers and other varieties of hole openers (e.g., bi-center bits).

Bit Face Differential Rate of Penetration

Figure 11A:
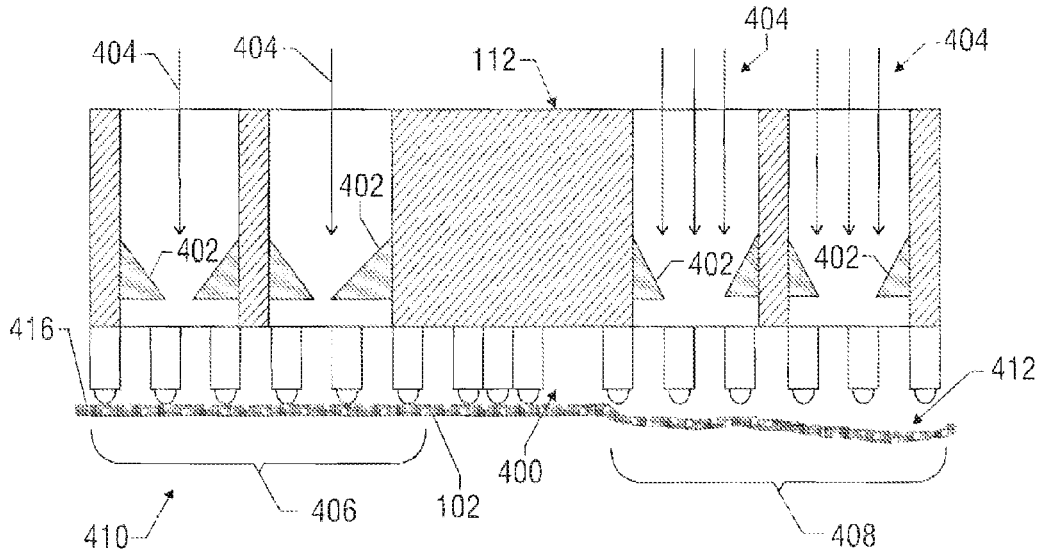
FIG. 11A illustrates one embodiment of a differential cutting steering unit made in accordance with the present invention that modulates drilling fluid flow.

Referring now to FIG. 11A, differential cutting steering systems change well bore path and direction by controlling the forward (face) rate of penetration of the bit 112. An aerially variable (i.e., in one orientation relative to the bore hole axis) cutting rate under a face 400 of the bit 112 can cause the well bore 102 to curve away from the higher ROP segment orientation. Thus, by controlling the cutting effectiveness or efficiency of one or more selected segments (e.g., a pie shaped wedge approaching 180 degrees in coverage) making up a forward bit face 400, the depth of cut can be increased in a consistent face segment (or range of segments) and this portion of the bore hole will be slighter deeper. After multiple rotations where the same face segment is deepened relative to other segments, the bore hole will bend away from the deep side of the bore hole. Exemplary non-limiting embodiments for preferential or differential cutting are described below.

Referring still to FIG. 11A, there is shown a drill bit 112 provided with a plurality of nozzles 402 that utilize smart materials to modulate the flow through the nozzle 402. By selectively and dynamically changing the flow through one or more of the nozzles 402 (synchronous with the bit 112 rotation to manage the face segment influenced), the degree of bottom hole cleaning in one segment of the hole can be made more or less effective versus another segment. In the illustrative embodiment shown in FIG. 11A, nozzles 402 formed of smart materials or controlled by smart material restrictions restrict the flow of drilling fluid 404 when subjected to a suitable excitation signal. Thus, for instance, a first set of nozzles 402 denoted by numeral 406 and a second set of nozzles 402 denoted by numeral 408 restrict flow upon entering a first selected sector 410 below the bit face 400 and allows full drilling fluid flow upon entering a second selected sector 412 below the bit face 400. The nozzle sets 406 and 408 cycle the flow of fluid at a frequency that corresponds to the RPM of the bit 112. This differential bottom hole cleaning results in a differential rate of penetration across the bottom of the hole. For instance, drilling cuttings 416 accumulate to a greater degree under segment 410, which reduces ROP and causes the desired change in well path direction.

Figure 11B:
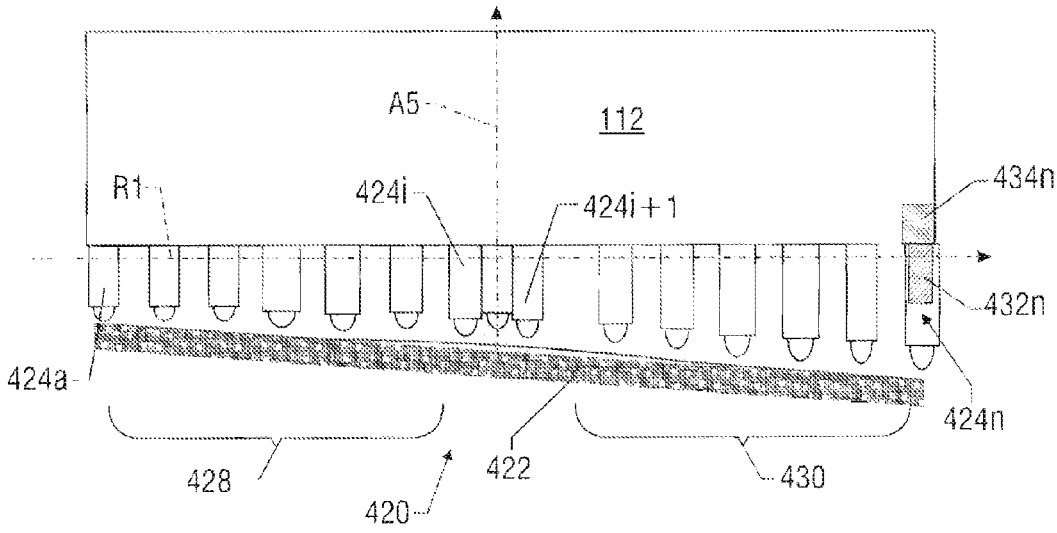
FIG. 11B illustrates one embodiment of a differential cutting steering unit made in accordance with the present invention that controls cutter extension into a wellbore bottom.

Referring now to FIG. 11B, there is shown an embodiment of a steering unit 420 that aerially modifies bottom hole cutter contact loading on the wellbore bottom 422. The steering unit 420 includes a plurality of cutters 424*a-n*, which are disposed on a face 426 of a drill bit 112, that can be individually or collectively (e.g., selected groups) axially lengthened. For instance, cutters 424*i*+1 to 424*n*, when activated by an appropriate excitation signal, extend deeper into the wellbore bottom 422 than cutters 424*a* to 424*i*. Moreover, cutters 424*i*+1 to 424*n* can extend the same depth into the wellbore bottom 422 or have a graduated depth or extension. By changing local WOB or force applied to individual or groups of cutter 424*a-n*, the cutter embedment can be preferentially controlled to increase/decrease rate of penetration (ROP) in one wellbore bottom sector or segment 428 versus another wellbore bottom sector or segment 430. Thus, the bit face 426 effectively deforms so that the plane of the face of the bit 112 is extended or retracted from an average or reference face plane R1. This cutter extension/retraction creates a force imbalance (greater or less than average cutter force) between one or more cutters 424*a-n* and will cause the wellbore bottom 422 to become non-perpendicular to the axis A5 of the bit 112 through controlled differential ROP. At the same time summation of the force vector lines from the cutters 424*a-n* in contact with the wellbore bottom 422 no longer pass through the center of bit 112 rotation. As shown in representative cutter 424*n*, the axial extension/retraction of the cutters 424*a-n* is provided by the selective excitation of a smart material 432*n* incorporated into the cutter post, mount structure or other component to move the cutter relative to the bit face. A signal/filed generation device, conductor or other suitable excitation signal generator 434*n* disposed in the drill bit 112, can be used to produce the excitation signal or field. Data, command signals, and power can be transmitted to the steering unit 420 via a short hop telemetry system, hard wiring, inductive coupling or other suitable transmission devices and systems.

Figure 11C:
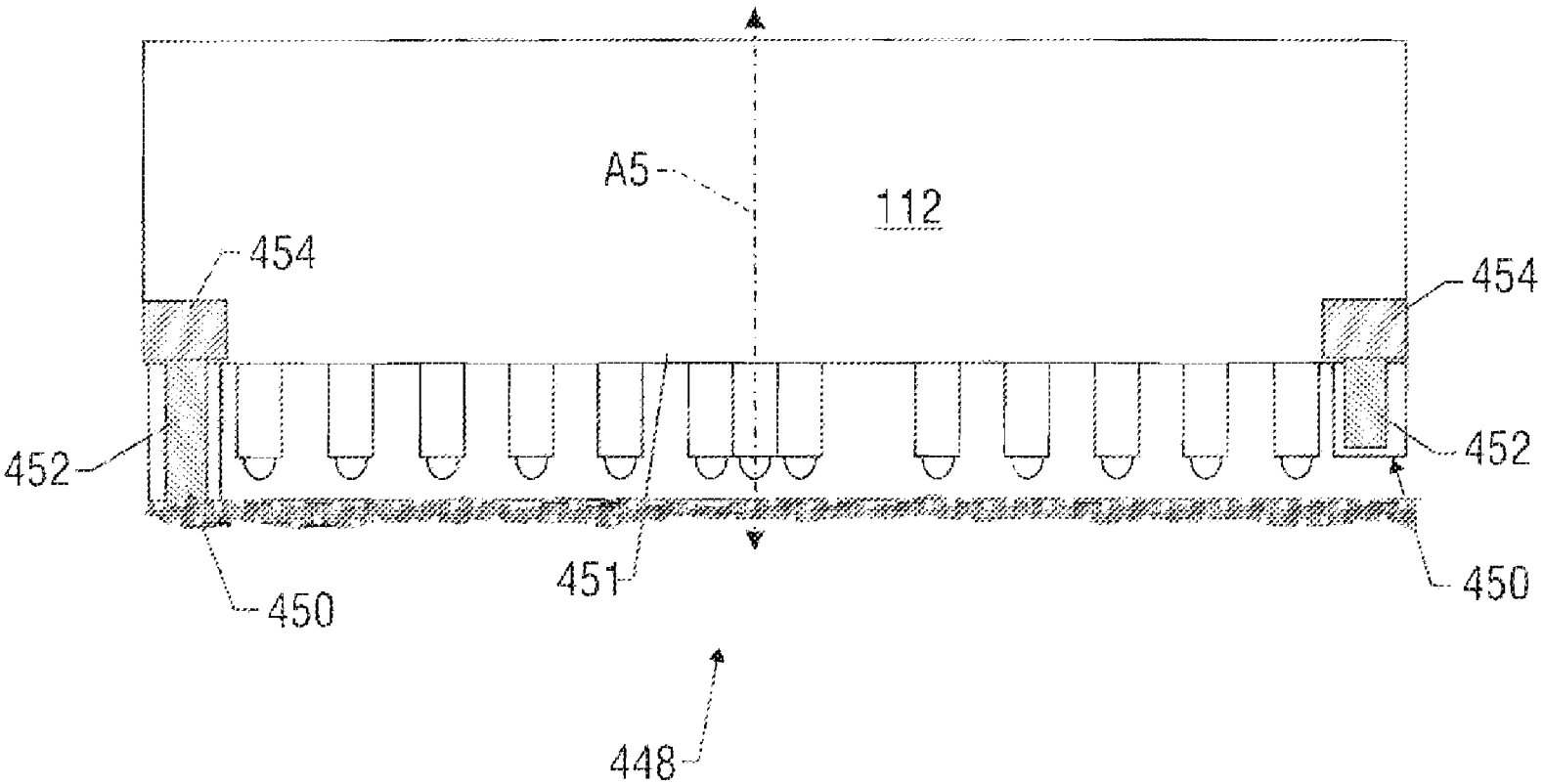
FIG. 11C illustrates one embodiment of a differential cutting steering unit made in accordance with the present invention that controls bit face protrusion height.

Referring now to FIG. 11C, in another embodiment, a steering unit 448 actively controls segmental depth of cut using smart materials to alter the height of one or more depth of cut (DOC) limiting protrusions 450 provided on a bit face 451. Some fixed cutter matrix bits (PDC and some impregnate) include DOC limiting protrusions set at a fixed depth from a reference or control cutter face. The rate of penetration can be controlled by differentially moving the DOC protrusion 450 in or out of the bit face 451 in one orientation relative to the bit 112 centerline A5. As discussed with reference to FIG. 11B, the differential rate of cut can alter bit drilling direction. The axial extension/retraction of the protrusions 450 is provided by the selective excitation of a smart material 452 incorporated into the protrusions 450. A signal/filed generation device, conductor or other suitable excitation signal generator 454 disposed in the drill bit 112, can be used to produce the excitation signal or field. Data, command signals, and power can be transmitted to the steering unit 448 via a short hop telemetry system, hard wiring, inductive coupling or other suitable transmission devices and systems (not shown). While two protrusions 450 are shown, greater or fewer may be used.

While FIGS. 11A-C illustrate a fixed cutter style bit, the above described method and arrangement can also be adapted to other styles of bits, including, but not limited to, roller cone bits, winged reamers and other varieties of hole openers (e.g., bi-center bits).

Referring generally to the Figures discussed above, the manner in which a steering unit is incorporated into the BHA 108 can influence the type of control the control unit exerts over the steering unit. For instance, in certain embodiments, such as during sliding drilling, a drilling motor, which can be substantially stationary relative to the wellbore 102, rotates the drill bit 112. In such applications, an arrangement can be devised such that the steering unit (e.g., the steering units of FIG. 4 or 8) is fixed to the drilling motor or other non-rotating portion of the BHA 108. Thus, the steering unit would be substantially stationary relative to the wellbore 102. To alter bit 112 direction, such a control unit transmits excitation signals that effectively bend a portion of the BHA 108 (e.g., through local geometry change or composite geometry change) to create a tilt angle that points the bit 112 in a specified direction. Because the steering unit is not rotating relative to the wellbore 102, this bend can remain substantially fixed (other than to correct for changes in BHA and/or steering unit orientation) until the next desired change in bit 112 direction/orientation.

In other arrangements, however, the steering unit can rotate. For example, the steering unit may be fixed directly or indirectly to the drill bit 112 and rotate at the rotational speed of the drill bit 112 (e.g., as shown in FIG. 10). Also, during rotary drilling, the steering unit may be positioned in a rotating drill string 110 and rotate at the rotational speed of the drill string 110 (e.g., as shown in FIGS. 9A-B). It should be apparent that a steering unit having a bend, causing a tilt, or causing differential cutting action, will "wobble" about the axis of rotation of the drill string or drill bit 112. Therefore, in these arrangements, a control unit continually transmits excitation signals to the steering unit to compensate for the rate of rotation of the drill string or drill bit 112 (hereafter "reference rotation"). That is, the excitation signals are generated in a reverse synchronous fashion relative to the reference rotation speed.

Figure 12:
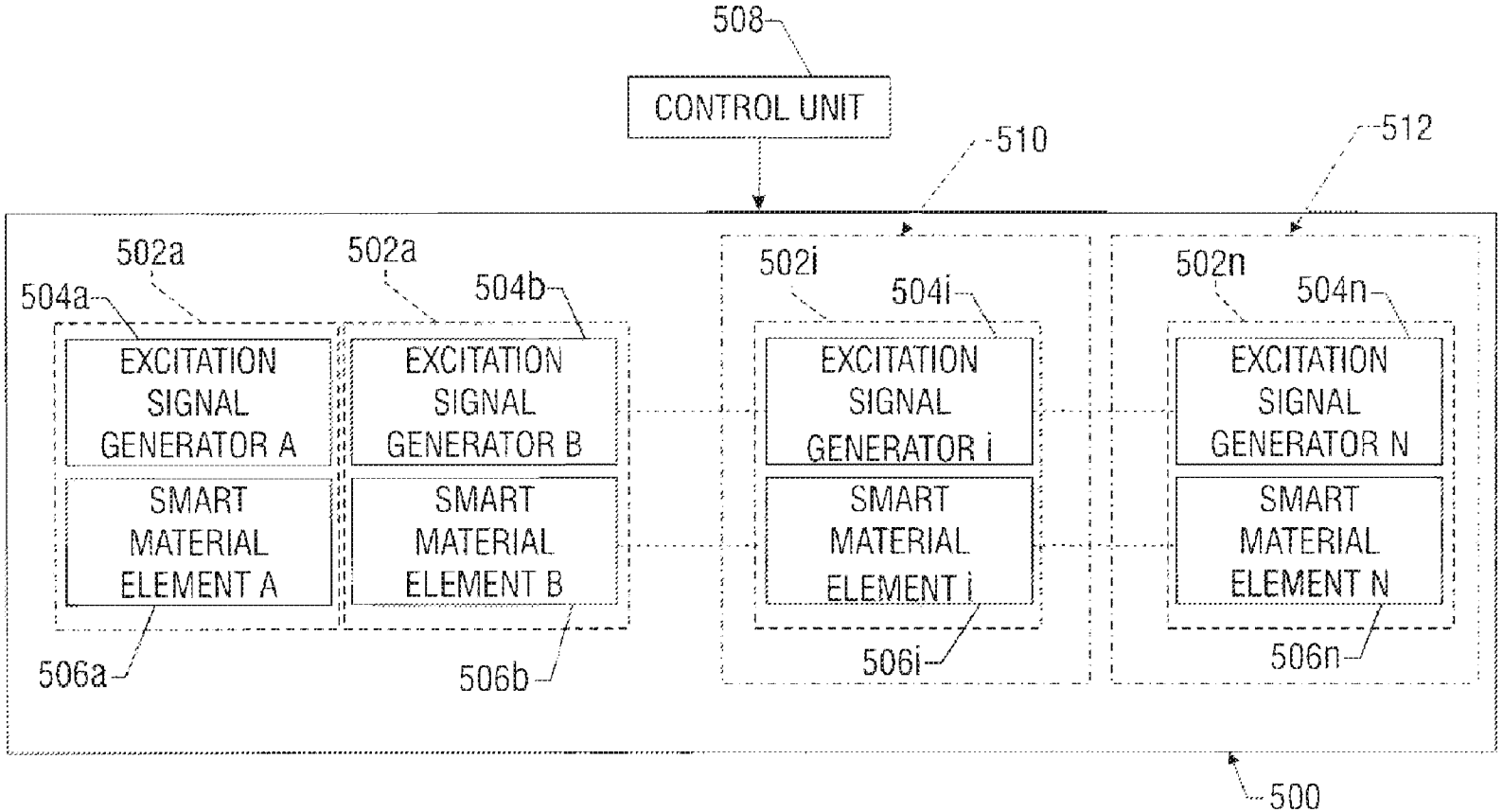
FIG. 12 illustrates a flow chart for controlling exemplary elements of a steering unit during directional drilling.

Referring now to FIG. 12, there is schematically illustrated an exemplary rotating steering unit 500 having a plurality of elements 502 that can be actively controlled to adjust/maintain/change drilling direction. The steering unit 500 is merely representative of the steering units previously discussed. Likewise the elements 502*a-n*, each of which have a smart material 504*a-n* and an associated excitation field/signal generator 506*a-n*, are representative of the arrangements previously discussed for effecting drilling direction; e.g., elements for changing system geometry, applying reaction forces, controlling fluid flow for differential cutting, etc.

In an exemplary use, a control unit 508 for controlling the steering unit 500 determines that the wellbore direction should be changed in accordance with a controlling condition, surface input, reservoir property, etc. Execution of the direction change can, for example, require that a bend, point, or differential cutting, etc. occur with reference to an arbitrary point or region such as top-dead-center (TDC) 510 of the wellbore. Because the elements 502*a-n* are rotating at the reference rotation speed RPM (which can be considered a frequency, i.e., cycles per second), an element 502*i* is at TDC 510 only once per rotation of the drill string or drill bit. Accordingly, the control unit 508 activates element 502*i* when entering TDC 510 and deactivates upon leaving TDC 510. Thus, the element 502*i* is activated at a frequency corresponding to the reference rotation RPM or frequency.

The control unit 508 can be programmed to adjust a number of variables in connection with the activation of the elements 502*a-n*. With respect to frequency of activation, the control unit 508 can activate the unit 502*i* at ratios of one activation per rotation/cycle, one activation per two rotations/cycles, one activation per three rotations/cycles, etc. Thus, the activation frequency can be less than one per rotation as long as the activation occurs while the unit 502*i* is within the selected region (e.g., TDC 510). Further, TDC 510 is merely one illustrative reference point. The region for activation may be an azimuthal sector having a specified arc (e.g., ninety degrees, one-hundred degrees, etc.). Thus, the zone or region wherein activation of the unit 502*i* can be adjusted. Another variable is the number of elements activated; i.e., groups of elements as well as individual elements such as elements 502*a-b* can be collectively energized. Moreover, the control unit 508 can select multiple zones or reference segments for activation. For example, an element 502*n* entering another reference point such as bottom-dead-center (BDC) 512 can be energized simultaneous (or otherwise) in conjunction with the activation of the elements entering TDC 510. For instance, an element entering TDC 510 can expand or lengthen while the element entering BDC 512 can retract or shorten.

Referring now to FIGS. 13A,B and 14A,B, there are shown mechanical steering devices that employ certain teachings of the present invention that may or may not utilize smart materials. While the devices are shown as part of a drill string or BHA, these devices can also be incorporated into a drill bit body in a manner previously described.

Referring now to FIGS. 13A,B, there is shown an adjustable joint 1000 having a first ring 1100 and a second ring 1200 that can rotate relative to one another about a reference tool center line X. Each ring 1100 and 1200 includes an inclined face 1102 and 1202, respectively, that bear on one another. In other embodiments, members such as tubulars, disks, plates, etc. that have inclined surfaces can be used instead of rings. As shown in FIG. 13A, the angles of inclination for the faces 1102 and 1202 are selected such that when rings 1100 and 1200 are at a selected baseline or nominal rotational position relative to one another, the angles of inclination of the faces 1102 and 1202 offset or cancel and the tool center line X is not deflected. As shown in FIG. 13B, a reference position R1 for ring 1100 and a reference position R2 for ring 1200, which can be arbitrarily defined, are set to cause no deflection of the tool centerline X.

In one embodiment, the rings 1100 and 1200 have at least two operational modes. First, the rings 1100 and 1200 rotate relative to one another to set the desired deflection angle, which then produces a corresponding tilt to the BHA/drill bit. Once the deflection angle is set, the relative rotation between the rings 1100 and 1200 is fixed until the deflection angle needs to be changed. Thus, the rings 1100 and 1200 are substantially locked together and the deflection angle does not change during a section of the drilling operation. If the joint 1000 is not being rotated (e.g., oriented slide drill mode), then the locked rings 1100 and 1200 are rotated as a unit only to maintain the proper orientation. During slide drilling, tools can tend to drift out of proper orientation. In such circumstances, the joint 1000 can be rotated as needed to counter any rotational drift caused by torsional or other dynamic string wind-up between down hole and the torsional anchor point (which can be at the surface or at a downhole anchor). During rotary drilling, the locked rings 1100 and 1200 are counter rotated as a unit at the speed of the string rotation so as to maintain the selected tilt angle heading.

Referring now to FIGS. 14A,B, the is shown the adjustable joint 1000 wherein the reference positions R1 and R2 have been shifted relative to one another to cause a tilt in the BHA as shown by deflected tool center line Y. In one embodiment, a downhole motor (e.g., electric, hydraulic, etc.) (not shown) is used to rotate one ring relative to the other. For example, the motor (not shown) is coupled to the first ring 1100 via a shaft (not shown) and the second ring 1200 is fixed or attached to a drill string (not shown), BHA (not shown) or drill bit (not shown). The motor is energized to make the appropriate alignment changes for R1 and R2 to cause the desired tool centerline deflection. In another mode of operation, the rings 1100 and 1200 (or other suitable members) are formed at least partially of a smart material. Thus, a control unit can provide an excitation signal to such rings in a manner that simulates an appropriate counter rotation.

Figure 15:
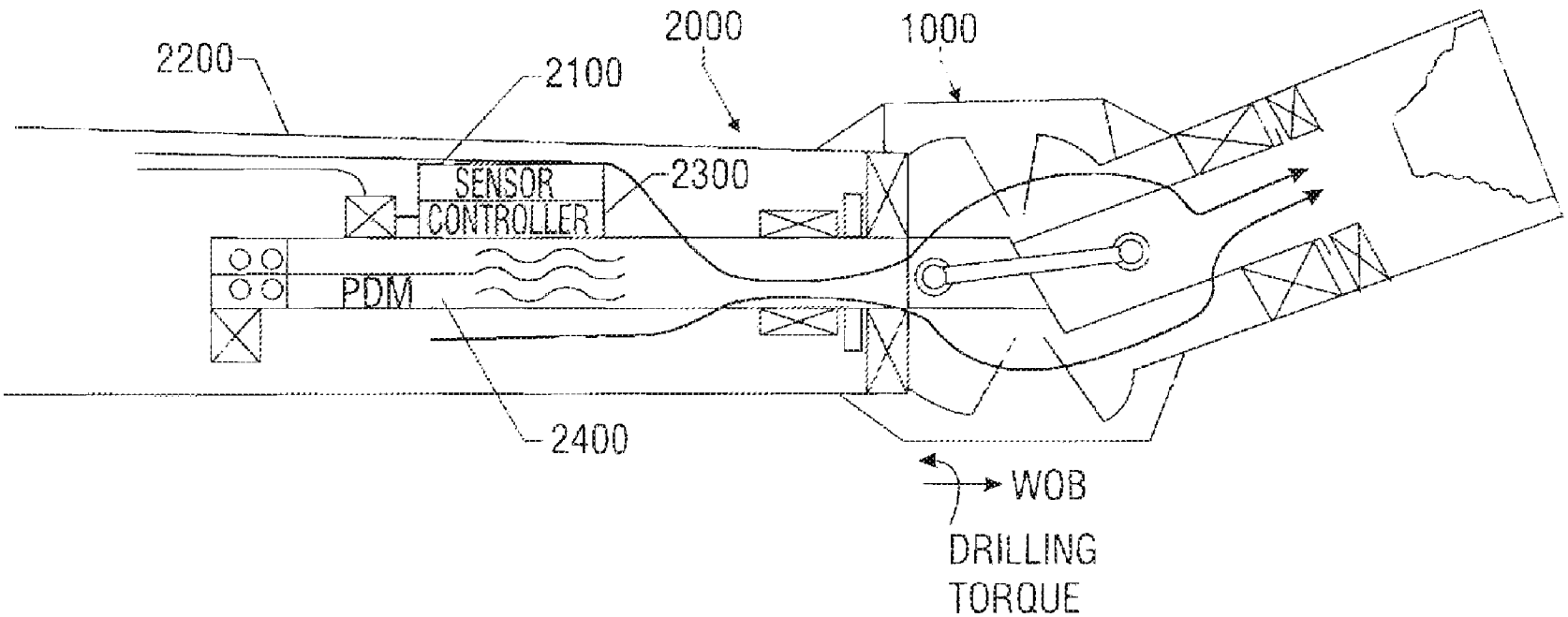
FIG. 15 illustrates one embodiment of a dynamically adjustable mechanical joint in accordance with the present invention that is disposed in a conventional BHA.

Referring now to FIG. 15, there is shown the adjustable joint 1000 disposed in a section of a BHA 2000. The joint 1000 includes a first ring 1100 and a second ring 1200. A positional sensor package 2100 is located within and rotating with a rotating drilling tubular 2200 that provides drilling torque and WOB for a drilling operation. The positional sensor package 2100 is configured to reference an external reference plane (e.g. gravity vector, magnetic field vectors, etc.) and actively correlate an internal reference plane to the external reference plane. This allows the sensor package 2100 to create a known orientation (it knows its global and local rotary orientation) to the reference vector during random rotation of the drilling tubular 2200. The sensor package 2100 provides input to a control/driver device 2300 that controls a secondary rotary drive device 2400 connected to the first ring 1100 and the second ring 1200 of the adjustable joint 1000. In one embodiment, the drive device 2400 counter rotates the joint 1000 to maintain a fixed or desired orientation to the external reference plane. In another embodiment, the control device 2300 provides an excitation signal that for energizing a smart material in the rings 1100 and 1200 to simulate an appropriate counter rotation. As noted earlier, nearly any member providing an inclined surfaces that produce a deflection of the BHA when aligned in a selected manner may be used in lieu of rings (e.g., tubulars, disks, plates, etc.).

It should be understood that the teachings of the present invention can be advantageously utilized in systems, devices and methods in arrangements that are variations of or different from the above-described embodiments. These teachings include, but are not limited to, steering units utilizing smart materials (hereafter "smart material steering units"), control units for canceling the effect the rotation of a drilling tubular or other member, and steering units utilizing actively adjustable rotating members (e.g., tubulars, disks, rings, plates, etc.) (hereafter "rotating member steering units"). Merely for convenience, a few of the above-described teachings are repeated, in albeit cursory fashion, below:

Systems, devices and methods have been described for use in a rotary drilling system (i.e., bit driven by drill string rotation) wherein (i) excitation of a smart material in a smart material steering unit causes a change in BHA geometry or operation (e.g., tool center line deflection, force vector change, differential cutting, etc.); and (ii) a control unit excites the smart material at a frequency that simulates a counter rotation at a speed that effectively cancels the drill string rotation.

Systems, devices and methods have been described for use in a rotary drilling system (i.e., bit driven by drill string rotation) wherein (i) a excitation of a smart material in a smart material steering unit causes a change in BHA geometry or operation (e.g., tool center line deflection, force vector change, differential cutting, etc.); and (ii) a control unit operates a rotary drive (e.g., a motor) coupled to the smart material steering unit to provide a counter rotation at a speed that effectively cancels the drill string rotation.

Systems, devices and methods have been described for use in a sliding drilling system (i.e., bit driven by downhole motor) wherein excitation of a smart material in a smart material steering unit causes a change in BHA geometry or operation (e.g., tool center line deflection, force vector change, differential cutting, etc.). No counter rotation is needed since the steering unit using the smart material is not rotating.

Systems, devices and methods have been described for use in a rotary drilling system (i.e., bit driven by drill string rotation) wherein (i) a rotating member steering unit is adjusted to cause a change in BHA geometry or operation (e.g., tool center line deflection, force vector change, differential cutting, etc.); and (ii) a control unit excites a smart material associated with the rotating member steering unit at a frequency that simulates a counter rotation at a speed that effectively cancels the drill string rotation.

Systems, devices and methods have been described for use in a rotary drilling system (i.e., bit driven by drill string rotation) wherein (i) a rotating member steering unit is adjusted to cause a change in BHA geometry or operation (e.g., tool center line deflection, force vector change, differential cutting, etc.); and (ii) a control unit operates a rotary drive (e.g., a motor) coupled to the rotating member steering unit to provide a counter rotation at a speed that effectively cancels the drill string rotation.

Also described are systems, devices and methods integral with or provided in a drill bit or other cutting structure to control drilling direction.

Although the teachings of the present invention have been discussed with reference to devices and systems for directional drilling, it should be apparent that the advantageous of the present invention can be equally applicable to other wellbore tools. For example, the system geometry change devices may be utilized with formation testing tools, wellbore completion tools, etc., including branch wellbore, lateral reentry guide tools, tools conveyed on drill pipe or coiled tubing, and casing exit oriented milling/cutting tools. Accordingly, while the foregoing disclosure is directed to the preferred embodiments of the invention, various modifications will be apparent to those skilled in the art. It is intended that all variations within the scope and spirit of the appended claims be embraced by the foregoing disclosure.

The invention claimed is:

1. An apparatus for use in drilling a wellbore, comprising:

a drill bit having a cutter member on a bit face;

a steering unit disposed in the drill bit, the steering unit containing a smart material in the cutter member configured to cause an axial movement of the cutter member, the axial movement defining a cutting of the formation by the cutter member, wherein a shape change of the smart material in response to a control signal applies a force to the cutter member to steer the drill bit by controlling a rate of penetration of a selected segment of the bit face, wherein the selected segment of the bit face comprises an area less than an entire cross sectional area of the bit face; and a control unit transmitting the control signal to the steering unit.

2. The apparatus according to claim 1 wherein the steering unit selectively adjusts a cutting depth of the cutter member on the selected bit face segment to thereby control the rate of penetration of the selected bit face segment.

3. The apparatus according to claim 1 further comprising a telemetry unit, wherein the control unit transmits control signals to the steering unit via the telemetry unit.

4. The apparatus according to claim 1 wherein the control unit provides the control signal at a frequency determined at least partially from a rotational speed of one of (i) the drill bit, and (ii) a drill string coupled to a bottom hole assembly containing the drill bit, the frequency causing the rate of penetration to act on substantially at least one selected sector of the wellbore.

5. The apparatus according to claim 1 wherein the smart material is selected from one of: (i) an electrorheological material, (ii) a magnetorheological material, and (iii) a piezoelectric material.

6. The apparatus according to claim 1 further comprising a rotation sensor for measuring a reference rotation, the rotation sensor providing the measurements to the control unit and wherein the control unit provides the control signal at a frequency determined at least partially using the rotational speed measurement.

7. The apparatus according to claim 1, comprising a drill string conveyed into the wellbore and a bottomhole assembly (BHA) coupled to an end of the drill string, wherein the BHA includes the drill bit.

8. The apparatus according to claim 1, wherein the steering unit is a differential cutting steering unit.

9. The apparatus according to claim 1, wherein the selected segment of the bit face is configured to remove a deepened portion of the wellbore relative to segments of the wellbore removed by other segments of the bit face.

10. A method for drilling a wellbore in an earthen formation comprising:

steering a drill bit using a steering device disposed in the drill bit, the steering device containing a cutter member on a bit face the cutter member including a smart material configured to cause an axial movement of the cutter member, the axial movement defining a cutting of the formation by the cutter member, wherein a shape change of the smart material in response to a control signal applies a force to the cutter member controlling a rate of penetration of a selected segment of the bit face, wherein the selected segment of the bit face comprises an area less than an entire cross sectional area of the bit face; and transmitting the control signal to the steering device from a control unit.

11. The method according to claim 10, further comprising changing a cutting depth of the cutter member on selected bit face segment to control the rate of penetration of the selected bit face segment.

12. The method according to claim 10 further comprising transmitting the control signals from the control unit to the smart material via a telemetry unit.

13. The method according to claim 10 wherein the control unit provides the excitation signal at a frequency determined at least partially from a rotational speed of one of (i) the drill bit, and (ii) a drill string coupled to a bottom hole assembly containing the drill bit, the frequency causing the rate of penetration to act on substantially at least one selected sector of the wellbore.

14. The method according to claim 10 wherein the smart material is selected from one of: (i) an electrorheological material, (ii) a magnetorheological material, and (iii) a piezoelectric material.

15. The method according to claim 10 further comprising measuring a reference rotation using a rotation sensor, and wherein the control unit provides the excitation signal at a frequency determined at least partially using the rotational speed measurement.

16. The method according to claim 10, comprising conveying a drill string into the wellbore, the drill string having the drill bit at an end thereof, wherein the drill bit is a fixed cutter bit.

17. The method according to claim 10, wherein steering the drill bit using a steering device comprises the selected segment of the bit face is removing a deepened portion of the wellbore relative to segments of the wellbore removed by other segments of the bit face.

18. The method according to claim 10, wherein the steering device is a differential cutting steering device.

* * * * *